US007592111B2

(12) United States Patent
Yu et al.

(10) Patent No.: US 7,592,111 B2
(45) **Date of Patent: *Sep. 22, 2009**

(54) IMAGING MEMBER

(75) Inventors: Robert C. U. Yu, Webster, NY (US); Satchidanand Mishra, Webster, NY (US); Anthony M. Horgan, Pittsford, NY (US); Richard L. Post, Penfield, NY (US); Yuhua Tong, Webster, NY (US); Edward F. Grabowski, Webster, NY (US); Kathleen M. Carmichael, Williamson, NY (US); Markus R. Silvestri, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 637 days.

This patent is subject to a terminal disclaimer.

(21) Appl. No.: 10/982,719

(22) Filed: Nov. 5, 2004

(65) Prior Publication Data

US 2006/0099525 A1 May 11, 2006

(51) Int. Cl.
*G03G 5/047* (2006.01)
*G03G 5/147* (2006.01)

(52) U.S. Cl. ..... 430/58.65; 430/58.75; 430/58.8; 430/59.6; 430/66; 430/67; 430/132; 430/133

(58) Field of Classification Search ..... 430/58.05, 430/58.65, 58.75, 58.8, 59.6, 66, 67, 132, 430/133, 970; 399/159
See application file for complete search history.

(56) References Cited

U.S. PATENT DOCUMENTS 3,121,006 A 2/1964 Middleton et al.
4,025,341 A 5/1977 Rule
4,233,384 A 11/1980 Turner et al.
4,265,990 A 5/1981 Stolka et al.
4,286,033 A 8/1981 Neyhart et al.
4,291,110 A 9/1981 Lee
4,299,897 A 11/1981 Stolka et al.
4,306,008 A 12/1981 Pai et al.
4,338,387 A 7/1982 Hewitt
4,439,507 A 3/1984 Pan et al.
4,587,189 A 5/1986 Hor et al.
4,806,443 A 2/1989 Yanus et al.
4,956,256 A * 9/1990 Ohtsuka et al. ..... 430/96
5,055,366 A 10/1991 Yu et al.
5,069,993 A 12/1991 Robinette et al.
5,473,064 A 12/1995 Mayo et al.
5,521,043 A 5/1996 Listigovers et al.
5,737,669 A * 4/1998 Ring ..... 399/130
5,830,614 A 11/1998 Pai et al.
5,863,685 A * 1/1999 DeFeo et al. ..... 430/58.35
5,948,789 A * 9/1999 Larsson et al. ..... 514/299
6,015,645 A 1/2000 Murti et al.
6,136,946 A * 10/2000 Yao et al. ..... 528/196
6,355,325 B2 * 3/2002 Yu et al. ..... 428/57
6,365,309 B1 * 4/2002 Tokutake et al. ..... 430/67
6,472,114 B2 * 10/2002 Morita et al. ..... 430/78
7,008,741 B2 * 3/2006 Yu et al. ..... 430/58.05
7,297,457 B2 * 11/2007 Horgan et al. ..... 430/58.8
7,413,835 B2 * 8/2008 Lin et al. ..... 430/58.05

OTHER PUBLICATIONS

Diamond, A.S., ed., *Handbook of Imaging Materials*, Marcel Dekker, Inc., NY (1991), pp. 395-396.*
Windholz, M., et al., ed., *The Merck Index*, 9th edition, Merck & Co., Inc, NJ (1977), pp. 497 and 1187.*
Aldrich Catalog Handbook of Fine Chemicals, Aldrich Company, 1998-1999, p. 1436.*

* cited by examiner

*Primary Examiner*—Janis L Dote
(74) *Attorney, Agent, or Firm*—Eugene O. Palazzo; Fay Sharpe LLP

(57) ABSTRACT

An electrostatographic imaging member formulated with a liquid carbonate is provided. The imaging electrostatographic member exhibits improved service life.

24 Claims, 2 Drawing Sheets

IMAGING MEMBER

BACKGROUND

Illustrated herein in embodiments are imaging members, such as electrostatographic imaging members exhibiting enhanced service life.

Electrostatographic imaging members are known in the art. Typical electrostatographic imaging members include, for example, photoreceptors for electrophotographic imaging systems and electroreceptors such as ionographic imaging members for electrographic imaging systems. Generally, these imaging members comprise at least a supporting substrate and at least one imaging layer comprising a thermoplastic polymeric matrix material. In a photoreceptor, the photoconductive imaging layer may comprise only a single photoconductive layer or a plurality of layers such as a combination of a charge generating layer and one or more charge transport layer(s).

Electrostatographic imaging members can be in the form of a number of different configurations. For example, they can comprise a flexible member formed by utilizing a flexible supporting substrate layer, or a rigid member, such as a drum. In this regard, flexible imaging members may consist of a flexible scroll configuration or a belt which may be seamed or seamless. Drum imaging members have a rigid cylindrical supporting substrate bearing one or more imaging layers.

The flexible electrophotographic imaging member belts are typically fabricated from a sheet which is cut from a web. The sheets are generally rectangular in shape. The edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic welding is generally the more desirable method of joining because it is rapid, clean (no solvents) and produces a thin and narrow seam. In addition, ultrasonic welding is more desirable because it causes generation of heat at the contiguous overlapping end marginal regions of the sheet to maximize melting of one or more layers therein to produce a strong fusion bonded seam.

A typical flexible electrophotographic imaging member belt comprises at least one photoconductive insulating layer. It is imaged by uniformly depositing an electrostatic charge on the imaging surface of the electrophotographic imaging member and then exposing the imaging member to a pattern of activating electromagnetic radiation, such as, light which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member or substrate such as paper.

A number of current flexible electrophotographic imaging members are multilayered photoreceptors that, in a negative charging system, comprise a substrate support, an electrically conductive layer, an optional charge blocking layer, an optional adhesive layer, a charge generating layer, and a charge transport layer. In such an imaging member, the charge transport layer is the top outermost layer exposed to the environment. An anti-curl layer may, for example, also be employed on the back side of the flexible substrate support, the side opposite to the electrically active layers, to achieve the desired photoreceptor belt flatness.

When a negatively charged photoreceptor belt is functioning under normal machine conditions of image creation and processing, the belt is mounted over and around a belt support module. As such, the belt is constantly subjected to bending strain as it flexes over each of the belt module support rollers during dynamic belt cyclic motion. The greatest bending strain is tension concentrated at the surface of the charge transport layer, so that extended belt cyclic flexing has been found to facilitate the development of surface cracking.

In this regard, surface cracking in the charge transport layer is somewhat unique only in belt photoreceptors and is induced, in part, due to the effect of dynamic fatigue of the belt flexing over the supporting rollers of a machine belt support module. Furthermore, surface cracking has also been found to be caused by exposure to airborne chemical contaminants as the photoreceptor segments statically "park" or directly bend over the rollers after periods of photoreceptor belt non-use during machine idling. Typical chemical contaminants that a photoreceptor belt can be exposed to include solvent vapors, environment airborne pollutants, and corona species emitted by machine charging subsystems. Surface cracking can also be exacerbated by the combination of the effects provided by fatigue belt flexing and airborne chemical exposure. In fact, the problem of photoreceptor surface cracking is a critical mechanical issue seen in imaging members, particularly, in flexible belts, because the cracks manifest themselves into printout defects that seriously impact copy quality. Similarly, the charge transport layer has also been found to be susceptible to surface scratching which often produces copy defect problems as well.

Furthermore, each charge transport layer of multi-layered photoreceptors is typically formed by a solution coating processes. The coating solutions generally contain from about 75% wt to about 91% wt organic solvent(s), such as methylene chloride or a chlorinated solvent. After application of the coating solution, the wet coating layer is dried at elevated temperatures to remove a substantial amount of the solvent to produce a solid layer.

Since solutions used by conventional coating processes are prepared utilizing organic solvents, it has been found that not all of the solvent may be removed from the coating layer during drying. For example, during the production solution coating of a typical charge transport layer containing about 86% wt methylene chloride solvent and 14% wt dissolve solid, the solvent evaporates very quickly during the elevated temperature drying process. However, about 2% wt of the methylene chloride will typically still be present or trapped in the resulting charge transport layer (i.e., residual methylene chloride). The trapped solvent may evaporate or "outgas" over time. However, the eventual out gassing of the trapped solvent from the charge transport layer after storage and over the life of the photoreceptor causes dimensional contraction of the charge transport layer. This results in a build-up of internal strain in the charge transport layer. Thus, in addition to the bending strain induced during dynamic photoreceptor belt flexing over each belt module support roller in a machine, this build-up of internal strain will exacerbate charge transport layer cracking under normal belt functioning conditions in the field.

Furthermore, dimension contraction in the charge transport layer causes the photoreceptor belt to exhibit upward curling at both edges when the belt functions in a machine. Since the contraction in belt direction is prevented by the applied tension as the belt is mounted over and around a belt support module, exhibition of edge curling in the photoreceptor belt is an important issue. This is because, in part, edge curling changes the distance between the belt surface to the charging device, causing non-uniform surface charging density which is then reflected as a "smile print" defect. Such a defect is characterized by higher intensity print-images at the locations over both belt edges.

Moreover, while much of the solvent vapor emission produced during the solution coating applications can be recovered by various abatement processes to prevent release of the solvent vapor into the atmosphere, these processes are costly and not fully efficient. Hence, a need also exists for the formation of a charge transport layer such that its coating does not create significant environmental pollutant emissions or cause safety and health issues.

Furthermore, since the charge transport layer of a typical negatively charged multilayered photoreceptor belt is the top outermost exposed layer, such a charge transport layer is inevitably subjected to constant mechanical interactions against various electrophotographic imaging machine subsystems under a normal service environment. These interactions include abrasive contact with cleaning and/or spot blades, exposure to toner particles, carrier beads, toner image receiving substrates, etc. Therefore, the charge transport layer may frequently exhibit mechanical failures such as frictional abrasion, wear, and surface cracking due to fatigue dynamic belt flexing. This can also be exacerbated by solvent vapor exposure, etc. Accordingly, a further need exists to provide protective coverage over the charge transport layer to effectively surpass these mechanical difficulties.

To resolve one or more of the above-noted shortcomings and issues, various methods of fabrication of improved electrophotographic imaging members have been investigated and successfully demonstrated as noted below. The imaging members produced thereby exhibit good cracking resistance, wear resistance, and durability. Such imaging member belts exhibit enhanced physical/mechanical functioning life and a reduced charge transport layer cracking, etc.

REFERENCES

Various combinations of materials for the charge generating layers and charge transport layers have been disclosed.

Illustrated in U.S. Ser. No. 10/422,668, now U.S. Pat. No. 7,008,741, the disclosure of which is totally incorporated herein by reference, is a photoconductive imaging member containing a photogenerating layer, a charge transport layer, or a plurality of charge transport layers, and which charge transport, especially the top charge transport layer contains a vinyl containing organic compound.

U.S. Pat. No. 4,265,990, the disclosure of which is totally incorporated herein by reference, illustrates a layered photoreceptor having a separate charge generating layer and a separate charge transport layer. The charge generating layer is capable of photogenerating holes and injecting the photogenerated holes into the charge transport layer. The photogenerating layer utilized in multilayered photoreceptors includes, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,233,384; 4,306,008; 4,299,897; and, 4,439,507, the disclosures of each of these patents being totally incorporated herein by reference in their entirety.

U.S. Pat. No. 4,265,990 discloses a layered photoreceptor having a separate charge generating (photogenerating) layer and charge transport layer. The charge generating layer is capable of photogenerating holes and injecting the photogenerated holes into the charge transport layer. The photogenerating layer utilized in multilayered photoreceptors includes, for example, inorganic photoconductive particles or organic photoconductive particles dispersed in a film forming polymeric binder. Inorganic or organic photoconductive materials may be formed as a continuous, homogeneous photogenerating layer. The disclosure of this patent is incorporated herein by reference.

U.S. Pat. No. 4,806,443, the disclosure of which is also totally incorporated herein by reference, describes a charge transport layer including a polyether carbonate obtained from the condensation of N,N'-diphenyl-N,N'bis(3-hydroy phenyl)-[1,1'-biphenyl]-4,4'-diamine and diethylene glycol bischloroformate.

U.S. Pat. No. 4,025,341 describes a photoreceptor with a charge transport layer including a hole transporting material such as poly(oxycarbonyloxy)-2-methyl-1,4-phenylenecyclohexylidene-3-methyl-1,4-phenylene.

U.S. Pat. No. 5,069,993 issued to Robinette et al on Dec. 3, 1991—An exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder.

Illustrated in U.S. Pat. No. 5,055,366, the disclosure of which is incorporated herein by reference, relates to a protective overcoating layer for an electrophotographic imaging device which prevents crystallization and leaching of charge transport compounds in a charge transport layer of the device, while also preventing solvent and ink contact/bending stress induced charge transport layer cracking. The overcoating layer contains a film forming binder material or polymer blend doped with a charge transport compound in an amount less than about 10% by weight. The overcoating layer may alternatively contain a single component hole transporting carbazole polymer or a polymer blend of hole transport carbazole polymer with a film forming polymer.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene (DI3) in an amount of from about 1 part to about 10 parts, and preferably about 4 parts DI3, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer.

U.S. Pat. No. 5,830,614, the disclosure of which is further incorporated herein by reference, relates to a charge transport having two layers for use in a multilayer photoreceptor. The photoreceptor comprises a support layer, a charge generating layer, and two charge transport layers. The charge transport layers consist of a first transport layer comprising a charge transporting polymer (consisting of a polymer segment in direct linkage to a charge transporting segment) and a second transport layer comprising a same charge transporting polymer except that it has a lower weight percent of charge transporting segment than that of the first charge transport layer. In the '614 patent, the hole transport compound is connected to the polymer backbone to create a single giant molecule of hole transporting polymer.

However, while many of the abovementioned references attempt to offer solutions to the problems noted, they frequently create new ones. Therefore, notwithstanding the above, there remains a need to provide improved layer(s) of an imaging member that exhibits enhanced performance properties and which is more tolerant to failures caused by chemical, mechanical and electrical stresses, has enhanced photo-electrical performance, exhibits a reduced imaging member residual solvent content, results in a nearly solvent-less charge transport layer formulation, or has less propensity to produce charge transport layer surface cracking to thereby provide an effectual increase in functional life.

Although the re-formulations of solutions, coatings and layers disclosed herein are equally applicable to electrophotographic imaging members as well as electrographic imaging members in either flexible belt configuration or rigid drum form, for reason of simplicity, the disclosures herein below are focused and demonstrated in detail only for electrophotographic imaging members in flexible seamed belt designs.

BRIEF DESCRIPTION

There is disclosed in various embodiments herein, processes and compositions for extending the functional life of an electrophotographic imaging member under its normal service environment. These processes and compositions relate generally to the elimination of residual solvent in the charge transport layer(s); the creation of an imaging member protective overcoat; and, material re-formulation for the production of solvent-less charge transport layer(s).

One embodiment disclosed herein relates to a thermoplastic charge transport layer of an electrophotographic imaging member which contains a compatible high boiler carbonate monomer/oligomer liquid. The higher boiler carbonate liquid is added to reduce and/or eliminate the presence of residual solvent in the charge transport layer. Typical solvents used for charge transport layer coating solution preparations comprise methylene chloride, toluene, THF, or the like. The carbonate liquid, having a boiling point above 200° C., is added to a thermoplastic charge transport layer coating solution so that it will effectively flush-out the residual solvent from the coating after elevated temperature drying. The content of the carbonate liquid is from about 0.5 to about 15 weight percent based on the weight of the resulting dry thermoplastic charge transport layer, including from about 2 to about 6 weight percent to produce effective residual solvent removal. The carbonate liquid is materially chemically similar to the thermoplastic polymer binder and is compatible to the charge transport compound present in the charge transport layer. The presence of the liquid carbonate in the charge transport layer effects residual solvent flush-out and eliminates internal strain, while causing no deleterious changes on the overall photo-electrical function of the fabricated imaging member. Furthermore, the high boiling point of this liquid assures its permanent presence in the thermoplastic charge transport layer throughout the service life of the imaging member.

Also disclosed herein in another exemplary embodiment is an effective solution for suppressing the abovementioned cracking problem in the charge transport layer thereby extending the service life of an imaging member belt under its normal service environment. The imaging member comprises at least a charge generating layer and a thermoplastic charge transport layer deposited thereon. The thermoplastic charge transport layer has a lower surface in contact with the charge generating layer and an upper surface exposed to the environment. Additionally, the thermoplastic charge transport layer is formed from drying an applied wet coating layer of a solution comprising a film forming thermoplastic binder, a high boiling point carbonate liquid, and a charge transport compound all dissolved in an organic solvent. The concentration of the high boiling point carbonate liquid is present in an amount such that it effectively flushes out the residual solvent from the resulting thermoplastic charge transport layer during drying of the applied coating layer. Moreover, the inclusion of the high boiling point carbonate liquid also does not adversely impact on the photo-electrical function of the resulting imaging member.

In an additional embodiment disclosed herein, a process for reducing the residual organic solvent content of a thermoplastic charge transport layer is provided. The process comprises forming a coating solution comprising a thermoplastic polycarbonate binder, an organic solvent, a charge transport compound, and a high boiler carbonate liquid. The solution is then applied to the surface of a charge generating layer and dried to form a solid solution of thermoplastic charge transport layer. It has been found that the addition of the high boiler carbonate liquid, such as high boiler oligomer Bisphenol A carbonate liquid, significantly reduces or eliminates the amount of organic solvent retained in the thermoplastic charge transport layer. Consequently, little if any internal strain is accumulated in the resulting thermoplastic charge transport layer.

A further embodiment disclosed herein relates to an imaging member comprising a charge generating layer and a thermoplastic charge transport layer deposited thereon. The thermoplastic charge transport layer has a lower surface, which is in contiguous contact with the charge generating layer, and an upper outermost and exposed surface. The thermoplastic charge transport layer is free of any residual solvent. It is formed from a mixture comprising a film forming thermoplastic polymer binder, a molecularly dispersed or dissolved charge transport compound, and a high boiler oligomer carbonate liquid additive. The high boiler oligomer carbonate liquid additive is compatible with both the binder and the charge transport compound and it does not adversely impact the photo-electrical function of the fabricated imaging member. The high boiling oligomer carbonate liquid has a boiling point of at least about 200° C.

A still further embodiment relates to an electrophotographic imaging member comprised in sequence of a supporting substrate, an optional hole blocking layer, an optional adhesive layer, a charge generating layer, and a thermoplastic charge transport layer. The charge transport layer comprises a charge or hole transport component, a thermoplastic film forming polymer binder, preferably a polycarbonate, a high boiler oligomer carbonate liquid which is adequately effective for flushing out any residual solvent. The high boiler oligomer carbonate liquid is also compatible with both the polymer binder and the charge transport component. Compatibility of the oligomer carbonate liquid with all the material compositions of the thermoplastic charge transport layer is of significance, because it enables formation of a homogeneous material blend with the polymer binder and the charge transport component. Therefore, the oligomer carbonate liquid does not trigger development of phase separation in the material matrix of the resulting thermoplastic charge transport layer, and very importantly, it does not cause negative impact on the photo-electrical function of the fabricated imaging member.

In a further embodiment, there is provided an imaging member having an exposed thermoplastic charge transport layer containing a high boiler liquid organic additive, which organic additive is, for example, an unsaturated oligomer carbonate compound having the following Formula (I):

FORMULA (I)

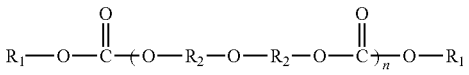

wherein $R_1$ is unsaturated hydrocarbon alkenyl group with, for example, from about 2 to about 5 carbon atoms, $R_2$ is saturated hydrocarbon alkyl group having from about 2 to about 3 carbon atoms, and n is an integer between about 1 and about 6.

In another exemplary embodiment, the Formula (I) additive incorporated in the thermoplastic charge transport layer, having $R_1$ and $R_2$ being the allyl group and ethylene segments, respectively, and with n equal to 1, is a specific monomer liquid of diethylene glycol bis(allyl carbonate) as described by Formula (II) below:

FORMULA (II)

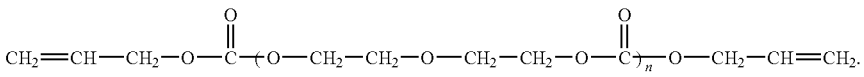

In still a further embodiment, the thermoplastic charge transport layer of the imaging members is alternatively incorporated with an unsaturated oligomer aromatic carbonate liquid additive having the following Formula (III):

FORMULA (III)

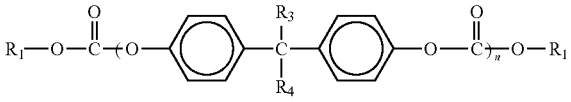

wherein $R_1$ is unsaturated hydrocarbon alkenyl group at each molecular terminal having from about 2 to about 5 carbon atoms, $R_3$ and $R_4$ are the same or different alkyl groups having about 1 to about 3 carbon atoms, and n being an integer between about 1 and about 6.

In a more particular exemplary embodiment, effective residual solvent elimination from the coated thermoplastic charge transport layer has been produced by an oligomer liquid of Formula (III), wherein n equals to 1, and $R_1$ being an allyl group while that of $R_3$ and $R_4$ are both methyl groups. Preferably, this oligomer liquid, is a carbonate derivative of Bisphenol A monomer. Therefore, the aromatic carbonate according to Formula (III) is specifically a Bisphenol A carbonate monomer liquid such as bis allyl carbonate of Bisphenol A shown as Formula (IV) below:

FORMULA (IV)

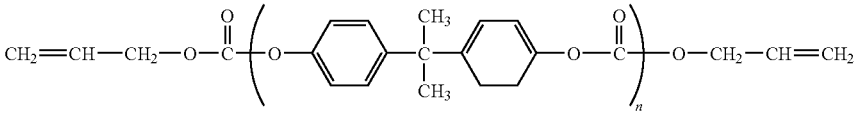

In all the embodiments described above, the level of oligomer liquid additive incorporated into the thermoplastic charge transport layer of an imaging member is in an amount of about 1 to about 15 weight percent; however, a level of from about 2 to about 6 weight percent to produce optimum residual solvent flushing. Such a content results in the elimination of internal strain without impacting the photo-electrical performance of the prepared imaging member.

In still another further embodiment, the thermoplastic charge transport layer of the imaging member may be formed to consist of dual layers or multiples of layers with each charge transport layer containing an additive of the oligomer carbonate liquid. In an alternative embodiment, an imaging member, formed to have a dual transport layer or multiple charge transport layers, contains the oligomer carbonate liquid only in the top or outermost charge transport layer.

In another embodiment, a layer is created and added to an imaging member, such as a protective overcoating layer, is formulated from a solution comprising a crosslinkable oligomer liquid carbonate and a crosslinking initiator to produce a hard crosslinked thermoset-plastic layer. Such a solution is coated over an imaging member to provide protection to the charge transport layer from cracking and wear. If needed, a small amount of a charge transport compound may also be included to enhance the photo-electrical performance of the overcoat layer. Furthermore, since the crosslinkable oligomer liquid carbonate can itself function as a solvent, the protective overcoating layer applied onto the imaging member, if desired, can also be produced with no, or only a minimal amount, of an additional solvent solution being utilized. The thermoset-plastic overcoat created is from about 0.5 micrometers to about 8 micrometers in thickness; but a thickness of from about 2 micrometers to about 5 micrometers may be more desirable.

In a further embodiment disclosed herein, there is provided an imaging member comprising a charge generating layer and a thermoplastic charge transport layer deposited thereon. The thermoplastic charge transport layer has a lower surface which is in contiguous contact with the charge generating layer, and an upper surface which is at least substantially covered with a protective overcoating layer. The thermoplastic charge transport layer comprises a film forming thermoplastic binder and a charge transport compound molecularly dispersed or dissolved therein to form a solid solution. The protective overcoating layer is a thermoset-plastic overcoat formed from a coating solution comprising an oligomer liquid carbonate and a crosslinking initiator. Optionally, small amounts of a charge transport compound can also be included in the coating solution, if needed, to improve the resulting overcoat's photo-electrical function. Upon application of the coating solution to the upper surface of the thermoplastic charge transport layer, the crosslinking initiator reacts with the allyl terminal groups of oligomer or liquid carbonate, at elevated temperature, to initiate the crosslinking reaction and effectively converting the liquid coating into a three dimensional solid network. This results in a hard thermoset-plastic overcoating layer. It is important to note that in the overcoating process, little, if any, organic solvent vapor needs to be recovered utilizing such material formulation, since the oligomer liquid carbonate essentially acts as its own solvent in the coating solution.

In this embodiment, the overcoating layer applied over the upper surface of the thermoplastic charge transport provides imaging member protection. The protective overcoating layer is a thermoset-plastic formed from crosslinking reaction of a solution comprising a liquid oligomer carbonate, such as any of the carbonate formulas described in preceding paragraphs. For example, the protective overcoat can be formed with the use of a liquid Bisphenol A carbonate monomer and a carbonate peroxide initiator. Optionally, variable amounts of a charge transport compound, such as an aryl amine, can also be included, if necessary, to enhance photo-electrical function.

In another embodiment, the thermoplastic charge transport layer of an imaging member is replaced with a thermoset-plastic charge transport layer. The thermoset-plastic charge transport layer is formed with new material formulations without the use of an organic solvent. In essence, it is a solvent-less solution coating process utilizing a solution prepared with a crosslinkable oligomer carbonate liquid, a charge transport compound readily dissolved therein, and a crosslinking initiator that triggers crosslinking reaction of this liquid charge transport layer mixture at elevated temperatures. The crosslinking reaction converts the applied liquid coating layer into a three-dimensional solid network thermoset-plastic charge transport layer.

In a still further embodiment, an imaging member is provided comprising at least a charge generating layer and an outermost and exposed charge transport layer. The charge transport layer is formed from a solution comprising a liquid oligomer carbonate, a charge transport compound and a crosslinking initiator. Upon solution application of the charge transport layer to the surface of the charge generating layer, the crosslinking initiator reacts with the liquid oligomer carbonate, at elevated temperatures, to convert the entire applied coating layer into crosslinked solid thermoset-plastic charge transport layer. The resulting thermoset-plastic charge transport layer, is in contiguous contact with the charge generating layer, and comprises no residual solvent. This is because the liquid oligomer carbonate does itself function as a vehicle to allow the preparation of a charge transport layer coating solution without the introduction of an organic solvent. This embodiment not only produces a mechanically robust thermoset-plastic charge transport layer free of residual solvent induced internal strain, it also provides an imaging member production process with a viable solvent-less coating formulation.

In still another embodiment, the thermoplastic charge transport layer of an imaging member is alternatively replaced by using a new material formulation so that the coating solution is prepared without the use of an organic solvent. In essence, a charge transporting compound is first mixed and dissolved directly into liquid Bisphenol A carbonate monomer of Formula (IV) to produce a solution without the need of a solvent. By the addition of a small quantity of crosslinking initiator into the solution, an enhanced charge transport layer coating solution is formed. The prepared coating solution is applied directly over the charge generating layer to produce a wet coating layer. The liquid Bisphenol A carbonate monomer of the applied coating layer is then transformed, at elevated temperatures, into a three dimensional solid network thermoset-plastic charge transport layer. This is initiated by a crosslinking reaction through linkages between the intermolecular allyl terminal groups to form a resulting thermoset-plastic charge transport layer containing no residual solvent content.

In yet another embodiment, the electrophotographic imaging member comprises a dual charge transport layer consisting of a first or bottom thermoplastic charge transport layer in contiguous contact with the charge generating layer and a second or top solid solution thermoset-plastic charge transport layer. The dual charge transport layer comprises two distinctive layers: the bottom layer is a solid solution consisting of a film forming thermoplastic polymer binder and a charge transport compound, while the top layer the thermoset-plastic charge transport layer which binder is formed from the crosslinking of the liquid oligomer carbonate and containing a charge transport compound. The charge transport compound presence in the dual charge transport layers can be the same or different, but preferably with the top thermoset-plastic charge transport layer containing a lesser amount of the charge transport compound than that in the bottom thermoplastic charge transport layer.

Further disclosed herein is an electrophotographic imaging member comprising a charge generating layer and multiple thermoplastic charge transport layers consisting of a first or bottom thermoplastic charge transport layer comprised of a solid solution of a film forming thermoplastic polymer binder and a charge transport component, and thereover and in contact with the first layer, a plurality of additional charge transport layers. These additional charge transport layers are thermoplastic layers comprising two or more distinctive layers, except that the top exposed layer being a thermoset-plastic charge transport layer; each of the thermoplastic charge transport layer can consist of same or different film forming thermoplastic polymer binder and same or different charge transport component as that of the first thermoplastic charge transport layer. However, in the layers, the content of charge transport component is reduced in a stepwise, or graduated, concentration gradient from the first layer located in closest proximity to the charge generating layer to the top or uppermost exposed thermoset-plastic charge transport layer. The plurality of the additional charge transport layers comprises from at least 2 to about 15 layers and, more specifically, from about 2 to about 4 layers.

In yet a still further embodiment, the electrophotographic imaging members containing either dual or multiple charge transport layers comprised of two or more thermoset-plastic layers created according to the material formulations disclosed herein.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1A:
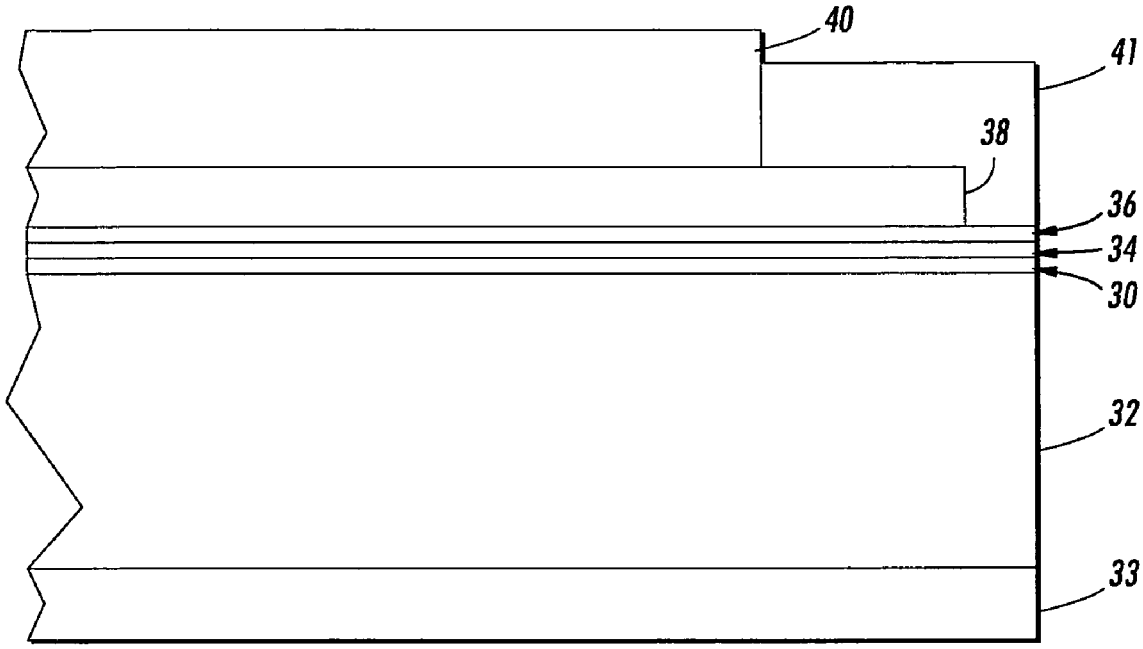
FIG. 1A is a schematic cross-sectional view of an exemplary embodiment of an improved imaging member having a single layer charge transport layer.

Disclosed herein are imaging members having a residual solvent free thermoplastic charge transport layer, a thermoset-plastic overcoating layer, or a thermoset-plastic charge transport layer. These imaging members exhibit advantages such as the avoidance or effectual suppression of abrasive wear, imaging member curl-up, and/or early onset of charge transport layer cracking.

Although charge transport layer cracking is typically an outcome of long term extended imaging member belt fatigue cyclic function, the early onset of cracking or micro-cracking in charge transport layer can be initiated by the interaction with effluent of chemical compounds. These interactions include the exposure of the charge transport layer to volatile organic compounds, like solvents, selected for the preparation of the members, environmental contaminants, as well as corona emissions from machine charging devices. These interactions pre-maturely cut short the service life of the imaging member.

Furthermore, since the development of charge transport layer cracking is contributed by additional factors such as extended dynamic fatigue belt flexing/bending over various belt support module rollers under normal machine functioning conditions, there is therefore a need for the formation of a mechanical robust charge transport layer. In this regard, typical micro-cracks, created as a result of dynamic fatigue belt cycling, are for example from about 5 to about 10 micrometers in width, and from about 500 to about 800 micrometers in length; by comparison, those charge transport layer cracks initiated by chemical vapor counterparts are much larger and varying in size depending on the type of chemical vapor and concentration the imaging member is exposed to. Nevertheless, cracks present in the charge transport layer result in copy print out defects and also adversely affect other functional characteristics of the imaging member.

In addition to the effectual suppression of early onset of charge transport layer cracking caused by belt fatigue function and chemical vapor attack for imaging member, the imaging members having the added protective overcoating layer or provided with the improved mechanically robust charge transport layer disclosed herein, further provide robust mechanical function, such as for example enhancing the cracking, wear, and scratch resistance, to effect imaging member service life extension. Furthermore, the protective overcoating layer or charge transport layer provided herein also protects the imaging member from developing lateral surface conductivity, which in turn can cause image degradation problems, referred to as lateral conductivity migration (LCM).

Additionally, the crosslinkable liquid carbonate monomer utilized herein to produce the various layers of the present disclosure can also itself function as a solvent. Hence, one or more layers of the imaging member can be produced with literally no, or only a minimal amount, of the organic solvent being utilized. To provide further information, additional specification examples of various oligomer liquid carbonate are disclosed and more particularly described below.

Processes of imaging, especially xerographic imaging and printing, including digital, are also encompassed by the various exemplary embodiments set forth herein. More specifically, the layered photoconductive imaging members of this development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are also useful in color xerographic applications, particularly high-speed color copying and printing processes. In these applications, the imaging members are in embodiments sensitive in the wavelength region of, for example, from about 500 to about 900 nanometers, and in particular from about 650 to about 850 nanometers, thus diode lasers can be selected as the light source.

The exemplary embodiments of this disclosure are more particularly described below with reference to the drawings. Although specific terms are used in the following description for clarity purpose, these terms are intended to refer only to the particular structure of the various embodiments selected for illustration in the drawings and not to define or limit the scope of the disclosure. Furthermore, the same numerical numbers are used to identify same structure unless specified otherwise; it should also be noted that the relative dimensions of the structure are intentionally not drawn according to their relative proportion for the ease of discussion.

The detailed description set forth below relates to various exemplary embodiments of a negatively charged flexible electrophotographic imaging member. The flexible electrophotographic imaging member includes a substrate support, a multilayered photoimaging layer, such as for example a charge generating layer and a outermost exposed charge transport layer. In certain embodiments, a protective overcoating layer is added above the charge transport layer.

Additionally, an optionally, optically transparent anti-curl back coating may also be included to render imaging member flatness. The term optically transparent is defined herein as the capability of the anti-curl back coating to transmit at least about 98 percent of an incident light energy through the coating. The anti-curl back coating is required to have good adhesion bonding onto the supporting substrate.

In the embodiments of an electrophotographic imaging member having an outermost exposed charge transport layer as that illustrated in FIG. 1A, the charge transport layer is a thermoplastic layer formulated to eliminate residual solvent by incorporation of a liquid oligomer carbonate.

Figure 1B:
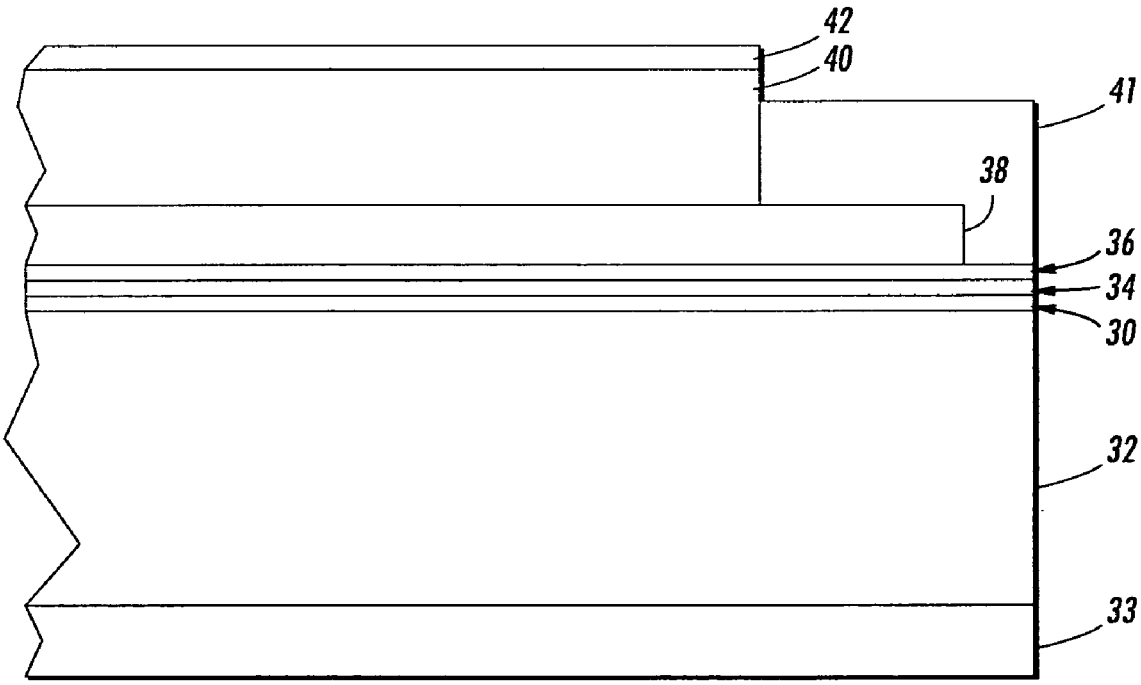
FIG. 1B is a schematic cross-sectional view of an exemplary embodiment of an improved imaging member having an added protective overcoating layer coated over a single layer charge transport layer

In the embodiments of an imaging member having an overcoating layer (or overcoat) over the charge transport layer, as that shown in FIG. 1B, the protective overcoating layer is formed from a liquid oligomer carbonate and a crosslinking initiator to convert the liquid oligomer into a solid overcoat. Optionally, variable amounts of a charge transport compound can also be included in the overcoat, if need, to enhance photo-electrical function of the resulting imaging member. Upon application onto the charge transport layer, such as by a coating process, the crosslinking initiator reacts and initiates a chemical reaction with the liquid oligomer carbonate, at elevated temperature, to transform the liquid coating into a crosslinked solid protective overcoating layer.

In the embodiments of an imaging member of FIG. 1A but created to have an improved outermost exposed charge transport layer, the charge transport layer is a thermoset-plastic layer formed from a liquid oligomer carbonate, a charge transport compound and a crosslinking initiator. Upon application of the charge transport layer onto the charge generating layer, the crosslinking initiator chemically reacts with the liquid oligomer carbonate to transform the liquid coating layer into a mechanically robust solid thermoset-plastic charge transport layer. As a result, an imaging member prepared to comprise this thermoset charge transport layer is so mechanically robust that it does not need a protective overcoating layer. The multilayered photoimaging layer may also include the following optional added layers: a conductive layer, a hole blocking layer, an adhesive layer, and/or a ground strip layer. These embodiments thereby relate to a solvent-less, or a substantially solvent free, charge transport layer formulation approach that is easily adoptable for flexible electrophotographic imaging member production coating implementation that provides resolution to the current solvent recovery problem and solvent environmental emission issue, as well crack and wear resistance enhanced charge transport layer.

Also disclosed herein are methods for making a flexible electrophotographic imaging member having innovative material designs and formulations that effect enhanced mechanical functional and service life extension. This fabrication process involves providing a substrate support having a first major surface and a second major surface. A multilayered photoimaging layer comprising a charge generating layer and one or more charge transport layers is then applied to the substrate support's first major surface and an optional protective overcoat layer is applied to the multi-layered photoimaging layer. Further optionally, an optically transparent anti-curl back coating is applied to the substrate support's second major surface to maintain imaging member flatness. Additional disclosures herein also include imaging members having multiple charge transport layers in which the top thermoset-plastic charge transport layer is formed according to the descriptions disclosed above.

An exemplary embodiment of the multilayered electrophotographic imaging member of flexible belt configuration of the present disclosure is illustrated in FIG. 1A. In this figure, the thickness of the substrate support 32 depends on numerous factors, including mechanical strength, flexibility, and economical considerations; and thereby, this layer for a flexible belt may, for example, have a thickness of at least about 50 micrometers, or of a maximum thickness not greater than about 150 micrometers, provided there are no adverse effects on the final electrophotographic imaging device. The substrate support 32 is not soluble in any of the solvents used in each coating layer solution, is optically transparent, and is thermally stable up to a high temperature of about 150° C. A typical substrate support 32 used for imaging member fabrication is, such as for example a biaxially oriented polyethylene terephthalate. Other suitable substrate materials include a biaxially oriented polyethylene naphtahlate, has a thermal contraction coefficient ranging from about $1\times10^{-5}$/° C. to about $3\times10^{-5}$/° C. and a Young's Modulus of between about $5\times10^{5}$ psi and about $7\times10^{5}$ psi.

The optional conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 Angstrom units and about 750 Angstrom units, and more specifically between about 50 Angstrom units and about 200 Angstrom units for an optimum combination of electrical conductivity, flexibility and light transmission. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, an optional hole blocking layer 34 may be applied thereto. Any suitable hole blocking layer capable of forming an effective barrier to holes injection from the adjacent conductive layer into the photoconductive or charge generating layer may be utilized. Examples of hole blocking layer may includes materials such as gamma amino propyl triethoxyl silane, zinc oxide, titanium oxide, silica, polyvinyl butyral, phenolic resins, and the like. The hole blocking layer of nitrogen containing siloxanes or nitrogen containing titanium compounds are as disclosed, for example, in U.S. Pat. No. 4,291,110, U.S. Pat. No. 4,338,387, U.S. Pat. No. 4,286,033 and U.S. Pat. No. 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of between about 0.2 and about 2 micrometers.

An optional adhesive layer 36 may be applied to the hole blocking layer. Any suitable adhesive layer may be utilized. One well known adhesive layer includes a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000 and a T~ of about 32° C. If desired, the adhesive layer may include a copolyester resin. The adhesive layer including the polyester resin is applied to the blocking layer. Any adhesive layer employed should be continuous and, more specifically, have a dry thickness between about 200 micrometers and about 900 micrometers and, even more specifically, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited coating may be effected by any suitable conventional technique such as oven drying, infra red radiation drying, air drying, and the like.

Any suitable charge generating layer 38 may be applied onto the adhesive layer 36 which can thereafter be coated over with a contiguous charge transport layer. Examples of charge generating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous charge generating layer. Benzimidazole perylene compositions are well known and described, for example, in U.S. Pat. No. 4,587,189, the entire disclosure thereof being incorporated herein by reference. Multi-charge generating layer compositions may be utilized where a photoconductive layer enhances or reduces the properties of the charge generating layer. Other suitable charge generating materials known in the art may also be utilized, if desired. Any suitable charge generating binder layer including photoconductive particles dispersed in a film forming binder may be utilized. For the charge generating binder layer, photoconductive particles such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are appropriate because of their sensitivity to white light. Vanadyl phthalocyanine, metal free phthalocyanine and tellurium alloys are also useful because these materials provide the additional benefit of being sensitive to infrared light. The charge generating materials selected should be sensitive to activating radiation having a wavelength between about 600 and about 700 nm during the imagewise radiation exposure step in an electrophotographic imaging process to form an electrostatic latent image.

Any suitable inactive film forming polymeric materials may be employed as binder in the charge generating layer 38 including those described, for example, in U.S. Pat. No. 3,121,006, the entire disclosure thereof being incorporated herein by reference. Typical organic polymer binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating composition or pigment can be present in the polymer binder composition in various amounts. Generally, from about 5 percent by volume to about 90 percent by volume of the photogenerating pigment is dispersed in about 10 percent by volume to about 95 percent by volume of the resinous binder, and more specifically from about 20 percent by volume to about 30 percent by volume of the photogenerating pigment is dispersed in about 70 percent by volume to about 80 percent by volume of the resinous binder composition.

The charge generating layer 38 containing photoconductive compositions and/or pigments and the polymer binder material generally ranges in thickness of from about 0.1 micrometer to about 5 micrometers, and more specifically has a thickness of from about 0.3 micrometer to about 3 micrometers. The charge generating layer thickness is related to binder content. Higher binder content compositions generally require thicker layers for charge generation. Thickness outside these ranges can be selected providing the objectives of the present development are achieved.

The charge transport layer 40, applied over the charge generating layer 38, may include any suitable transparent organic polymer or non-polymeric material capable of supporting the injection of photogenerated holes from the charge generating layer 38 and capable of allowing the transport of these holes through the charge transport layer to selectively discharge the surface charge on the imaging member surface. The charge transport layer 40 not only serves to transport holes, but also protects the charge generating layer 38 from abrasion or chemical attack and therefore extends the service life of the imaging member.

The charge transport layer 40 should exhibit negligible, if any, discharge when exposed to a wavelength of light useful in xerography, e.g., about 4000 Angstroms to about 9000 Angstroms. Therefore, the charge transport layer is substantially transparent to radiation in a region in which the photoconductor is to be used.

Furthermore, the charge transport layer 40 is a substantially non-photoconductive material, but supports the injection of photogenerated holes from the charge generation layer 38. The charge transport layer 40 is required to be transparent when exposure is effected through this active layer to ensure that most of the incident radiation is utilized by the underlying charge carrier generator layer 38 below to produce efficient photogeneration outcome. The charge transport layer 40 in conjunction with the generation layer 38 in the instant development is a material which is an insulator to the extent that an electrostatic charge placed on the transport layer is not conducted in the absence of illumination.

The charge transport layer 40, shown in FIG. 1A, is a thermoplastic coating layer which may be formed with any suitable activating compound useful as an additive molecularly dispersed in an electrically inactive film forming thermoplastic polymeric material to form a solid solution and thereby making this material electrically active. The activating compound may be added to a film forming thermoplastic polymer material which is otherwise incapable of supporting the injection of photogenerated holes from the charge generation material and incapable of allowing the transport of these holes therethrough. This will convert the electrically inactive thermoplastic polymer material into a material matrix capable of supporting the injection of photogenerated holes from the generation material and capable of allowing the transport of these holes through the active thermoplastic charge transport layer 40 in order to discharge the surface charge on this active transport layer.

The thermoplastic charge transport layer 40, is a binary solid solution comprising an activating organic compound molecularly dissolved in a polycarbonate binder of, typically, being either a poly(4,4'-isopropylidene diphenyl carbonate) or a poly(4,4'-diphenyl-1,1'-cyclohexane carbonate). The activating organic compound contained in the thermoplastic transport layer 40 is generally a diamine, disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507; these disclosures thereof are being incorporated herein in their entirety for reference. Typically, the thermoplastic charge transport layer 40 has a thickness of between about 10 and about 40 micrometers, a Young's Modulus in the range of from about $3.0\times10^5$ psi to about $4.5\times10^5$ psi, and with a thermal contraction coefficient of between about $6\times10^{-5}$/° C. and about $8\times10^{-5}$/° C.; it also has a glass transition temperature Tg of between about 75° C. and about 100° C.

Since the thermoplastic charge transport layer 40 applied by solution coating process has a great thermal contraction mismatch compared to that of the substrate support 32, the prepared flexible electrophotographic imaging member, at this point after coating layer elevated temperature drying, may exhibit spontaneous upward curling such as into a 1½ inch tube due to the result of larger dimensional contraction in the charge transport layer 40 than the substrate support 32, as the imaging member cools down to room ambient temperature. An anti-curl back coating 33 can be applied to the back side of the substrate support 32 (which is the side opposite the side bearing the electrically active coating layers) in order to render flatness. Although the anti-curl back coating 33 may include any suitable organic film forming polymers that are electrically insulating or slightly semi-conductive, but it is most preferably to be the same thermoplastic polycarbonate used in the charge transport layer binder. The anti-curl back coating from about 7 to about 30 micrometers in thickness is found to be adequately sufficient for balancing the curl and render imaging member flatness.

A complete material package of an electrophotographic imaging member does also include a conventional ground strip layer 41 including, for example, conductive particles dispersed in a film forming binder may be applied to one edge of the photoreceptor in contact with the conductive layer 30, hole blocking layer 34, adhesive layer 36 or charge generating layer 38. Ground strip layer 41 may include any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

Since the coating of the thermoplastic charge transport layer, of the prior art, over the charge generating layer 38 is applied from a solution prepared using methylene chloride solvent, the resulting charge transport layer 40, after elevated temperature drying, has been found to still contain from about 1.4 to about 2.1 weight percent of residual methylene chloride in all the production electrophotographic imaging member web stocks. The eventual loss of the residual solvent due to gradual out-gassing process, after imaging member self storage, converting into belts, or functioning under a machine service condition, has caused the imaging member to exhibit upward curling problem. The observed imaging member curling is the direct consequence of charge transport layer dimensional contraction to build-up internal tension strain in the layer as a result from losing the residual solvent. Upward curling seen in an imaging member belt is serious problem, because it changes the distance between the belt surface and the electrical charge device to impart un-uniform belt surface charge acceptance to directly affect the copy image printout quality. Moreover, the build-up of internal tension strain is also additive to charge transport layer bending strain induced by imaging member belt fatigue flexing/bending over each machine belt module support roller to promote early onset of charge transport layer cracking; the cracks are then printed out as defects in each output copy to pre-maturely shortening the service life of the belt.

Additionally, after imaging member converting into flexible belt and cyclic functioning in a machine, the outermost exposed thermoplastic charge transport layer 40 is subjected to constant mechanical contact and interaction against various xerographic imaging subsystems causing the charge transport layer to develop pre-mature wear problem, surface scratch, as well as early onset of solvent/chemical vapor exposure or fatigue induced cracking.

Therefore, fabrication of robust imaging member for effectual service life extension is of need to meet future machines functional life target requirement.

Three innovative approaches have been developed and successfully demonstrated to effect imaging member service life improvement are (1) residual solvent elimination, (2) addition of a protective overcoating layer, and (3) replacement of the thermoplastic charge transport layer with a thermosetplastic formulation by solvent-less coating; each of which is described in detail in the following:

(1) RESIDUAL SOLVENT FLUSH-OUT: To resolve and overcome the residual solvent associated issue seen in the thermoplastic charge transport layer 40, the thermoplastic charge transport layer of the electrophotographic imaging member is modified to incorporate a high boiler oligomer carbonate liquid to effect residual solvent elimination outcome. To accomplish this purpose, a small amount of a high boiler oligomer carbonate liquid is added to the coating solution, so that the drying process of an applied wet coating layer will facilitate the flushing out the methylene chloride (having a boiling point of 46° C.) to produce a dried charge transport layer virtually free of residual solvent content. The selection of the oligomer carbonate liquid is based on the facts that it is: (a) substantially chemically similar to the thermoplastic polycarbonate binder, (b) highly compatible with the diamine charge transport compound, and (c) a high boiler of exceeding 200° C. Oligomer carbonate liquid able to satisfy these 3 criteria is of importance in order to ensure that its presence in the charge transport layer is permanent and does not cause material phase separation to deleteriously impact the photoelectrical performance of the fabricated imaging member.

The modified and nearly residual solvent free charge transport layer is a thermoplastic binary solid solution comprised of a film forming thermoplastic polymer binder and a hole mobility organic charge transporting compound, but also a compatible high boiler carbonate liquid incorporation from about 0.5 to about 15 weight percent, including from about 2 to about 6 weight percent, based on the total weight of the fabricated thermoplastic charge transport layer.

Examples of charge transporting compounds included in the charge transport layer include triphenylmethane, bis(4-diethylamine-2-methylphenyl)phenylmethane, stilbene, and hydrazone; otherwise, an aromatic amine comprising tritolylamine; arylamine; enamine phenanthrene diamine; N,N'-bis(4-methylphenyl)-N,N'-bis[4-(1-butyl)-phenyl]-[p-terphenyl]-4,4"-diamine, N,N'-bis(3-methylphenyl)-N,N'-bis[4-(1-butyl)-phenyl]-[p-terphenyl]-4,4"-diamine; N,N'-bis(4-t-butylphenyl)-N,N'-bis[4-(1-butyl)-phenyl]-[p-terphenyl]-4,4"-diamine; N,N',N",N'"-tetra[4-(1-butyl)-phenyl]-[p-terphenyl]-4,4"-diamine; N,N',N",N'"-tetra[4-t-butylphenyl]-[p-terphenyl]-4,4"-diamine; N,N'-bis-(3,4-dimethylphenyl)-4-biphenyl amine; N,N'-diphenyl-N,N'-bis(4-methylphenyl)-1,1'-biphenyl-4,4'-diamine; N,N'-bis-(4-methylphenyl)-N,N'-bis(4-ethylphenyl)-1,1'-3,3'-dimethylbiphenyl)-4,4'-diamine; 4,4'-bis(diethylamino)-2,2'-dimethyltriphenyl methane; N,N'-diphenyl-N,N'-bis(3-methylphenyl)-[1,1'-biphenyl]-4,4'-diamine; N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. Since the last two aromatic diamines are commonly used hole transporting compound for typical electrophotographic imaging member fabrication, they are selected for presenting disclosure embodiment preparation and are thereby represented by the molecular structure A below:

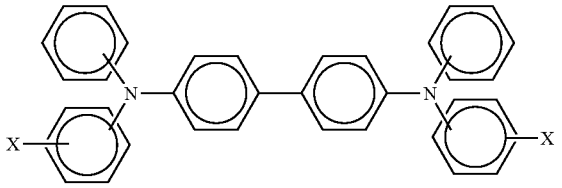

wherein X is selected from the group consisting of alkyl, alkoxy, hydroxy, and halogen.

The resulting thermoplastic charge transport layer 40 should be an insulator to the extent that the electrostatic charge placed on the thermoplastic charge transport layer is not conducted in the absence of illumination at a rate sufficient to prevent formation and retention of an electrostatic latent image thereon. In general, the ratio of the thickness of the charge thermoplastic transport layer to the charge generator layer is more specifically maintained from about 2:1 to about 200:1 and in some instances as great as about 400:1. Therefore, it is generally that the thickness of the thermoplastic charge transport layer is between about 5 micrometers and about 100 micrometers, but thickness outside this range can also be used provided that there are no adverse effects.

The thermoplastic charge transport layer 40 of this disclosure has a thickness of between about 10 and about 40 micrometers and may also include a blend of any suitable activating compounds useful as an additive dispersed in electrically inactive polymeric materials making them electrically active and a compatible high boiler liquid incorporation. Any suitable inactive film forming thermoplastic polymer binder soluble in methylene chloride, chlorobenzene or other suitable solvent may be employed in the process of this disclosure. Typical dried thermoplastic charge transport layer formulation of the present disclosure is, generally, a solid solution consisting of an activating organic compound molecularly dissolved in an inactive film forming polymer binder such includes, for example, polycarbonate, polystyrene, polyester, polyarylate, polyacrylate, polyether, polysulfone, and the like, plus the incorporation of a liquid oligomer carbonate; the liquid oligomer carbonate addition is from about 1 to about 15 weight percent, including from about 2 and about 6 weight percent, based on the total weight of the charge transport layer. Molecular weight of the thermoplastic binder can vary from about 50,000 to about 2,500,000. However, polycarbonate and polystyrene are generally the preferred thermoplastic binder of choice for charge transport layer formulation to give best mechanical and electro-photographic imaging results. Typical thermoplastic polycarbonate binder of interest is being either a poly(4,4'-isopropylidene diphenyl carbonate) or a poly(4,4'-diphenyl-1,1'-cyclohexane carbonate).

In further embodiments included herein, the modified thermoplastic charge transport layer 40 of this disclosure may comprise one of any types of liquid oligomer carbonate. The particulars of which are more specifically discussed below in reference to, for example, Formulas I-VII.

Figure 2:
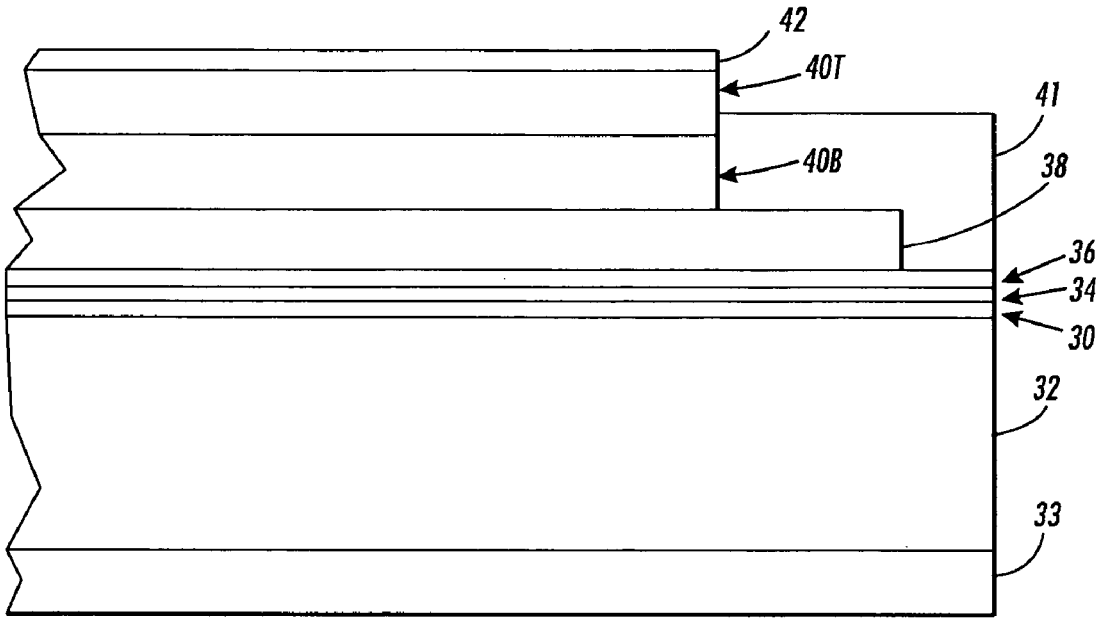
FIG. 2 is a schematic cross-sectional view of another exemplary embodiment in which the imaging member contains a protective overcoating layer and dual charge transport layers.

In additional embodiments, the single thermoplastic charge transport layer 40 of FIGS. 1A and 1B may comprise dual layers same as 40B and 40T illustrated in FIG. 2. Although it is preferred that only the top charge transport layer 40T comprises an oligomer carbonate liquid; however, both dual layers 40B and 40T may include same or different oligomer carbonate liquid additive.

Figure 3:
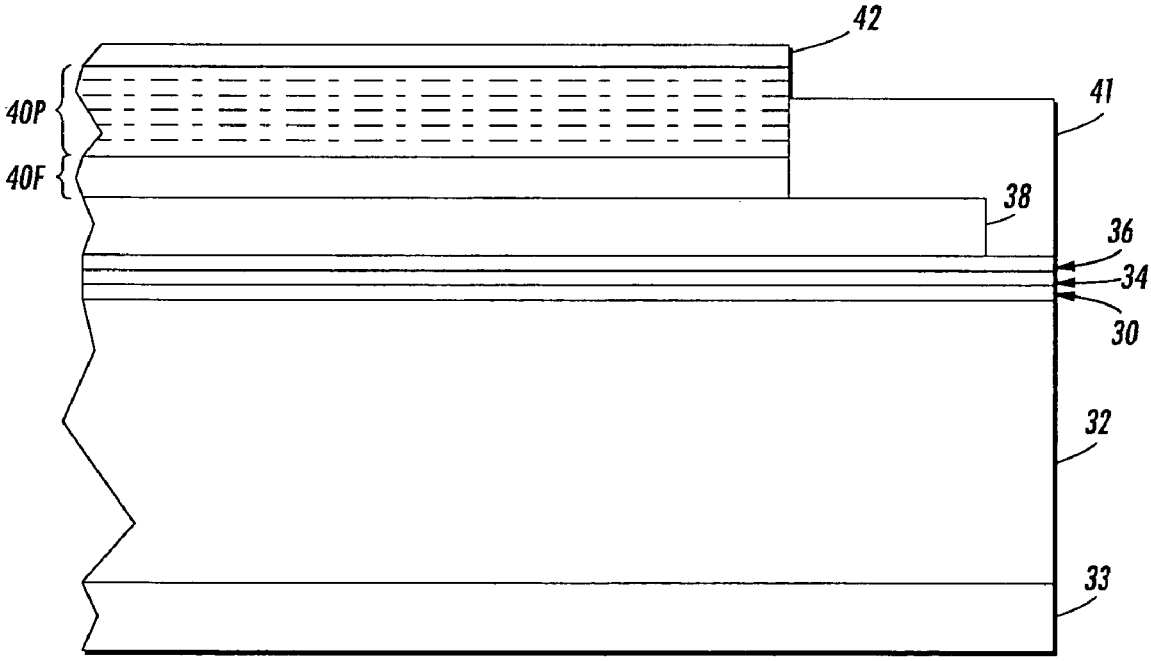
FIG. 3 is a schematic cross-sectional view of an additional exemplary embodiment of an improved imaging member. The imaging member, as illustrated, comprises a protecting overcoating layer and multiple charge transport layers.

In yet additional embodiments, the single thermoplastic charge transport layer 40 of FIGS. 1A and 1B may comprise dual or multiple charge transport layers as 40B and 40T or 40F and 40P shown in FIG. 2 and FIG. 3, respectively. Although it is preferred that only the top charge transport layer comprises an oligomer carbonate liquid; however, all the other layers may include same or different oligomer carbonate liquid additive.

(2) THERMOSET-PLASTIC PROTECTIVE OVERCOAT LAYER CREATION: An improved electrophotographic imaging member having mechanical robust function may alternatively be prepared by providing the thermoplastic charge transport layer 40 with the addition of a protective thermoset-plastic overcoating layer such as that shown in FIG. 1B. That is an overcoating layer 42 can be utilized and applied over the top surface of the thermoplastic charge transport layer 40 to provide protection disclosed in certain exemplary embodiments. The overcoating layer 42 added to an imaging member shown in FIGS. 1B, 2, and 3 is from about 0.5 to about 8 micrometers in thickness, including from about 2 to about 4 micrometers thick solid layer, created by crosslinking a liquid oligomer carbonate. The liquid oligomer carbonate has a general molecular structure as represented by:

FORMULA (I)

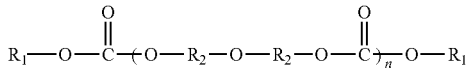

wherein $R_1$ is unsaturated hydrocarbon alkenyl group with, for example, from about 2 to about 5 carbon atoms, $R_2$ is saturated hydrocarbon alkyl group having from about 2 to about 3 carbon atoms, and n is an integer is between about 1 and about 6.

To effect the creation of thermoset-plastic overcoating layer 42 illustrated in FIG. 1B, a crosslinking initiator is added and mixed with the liquid oligomer carbonate of Formula (I) to form a coating solution. Upon application over the thermoplastic charge transport layer 40, the coating layer is then transformed into a crosslinked solid overcoating initiated, at elevated temperature, by crosslinking reaction through the intermolecular linkage formed between the alkenyl terminal groups. Examples of such crosslinking initiators include benzoyl peroxide, dicumyl peroxide, diisopropyl peroxydicarbonate, dicyclohexyl peroxydicarbonate, Bis(4-tert.butylcyclohexyl) peroxydicarbonate and the like. However, peroxydicarbonate, for example the Bis(4-tert.butylcyclohexyl) peroxydicarbonate having the molecular structure given below in Formula A is preferably used as initiator:

FORMULA (A)

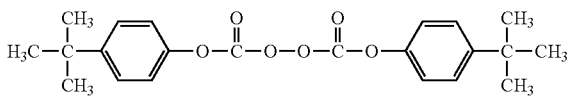

In one exemplary embodiment of creating the thermoset-plastic overcoating layer 42, the liquid oligomer carbonate of Formula (I) utilized (having $R_1$ and $R_2$ being the allyl group and ethylene segments, respectively, and with n equals to 1) is a specific monomer liquid of diethylene glycol bis(allyl carbonate) as described by Formula (II) below:

FORMULA (II)

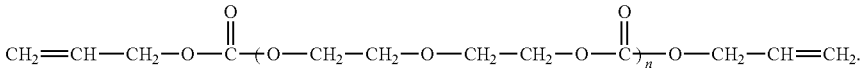

Alternatively, in other exemplary embodiments, the created thermoset-plastic overcoating layer 42 is comprised of an unsaturated oligomer aromatic carbonate of the following molecular structure:

FORMULA (IV)

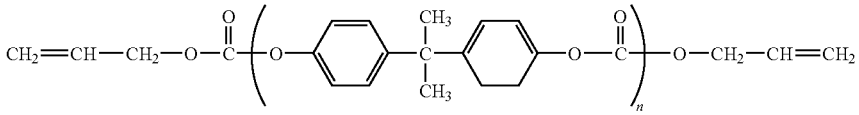

wherein $R_1$ is unsaturated hydrocarbon alkenyl group at each molecular terminal having from about 2 to about 5 carbon atoms, $R_3$ and $R_4$ are the same or different alkyl groups having about 1 to about 3 carbon atoms, and n is an integer from about 1 to about 6.

In a specific embodiment, the $R_1$ in the oligomer carbonate of Formula (III) is an allyl group and $R_3$ and $R_4$ are the same, being a methyl group, then the liquid used for creating the thermoset-plastic overcoating layer is an oligomer Bisphenol A carbonate shown in Formula (IV) below. However, if n is 1, Formula (IV) becomes a Bisphenol A carbonate monomer called bis allyl carbonate of Bisphenol A.

FORMULA (III)

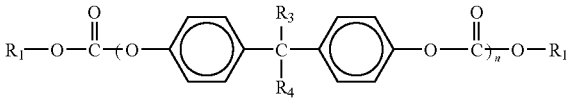

Alternative liquid oligomers of aromatic carbonate derived from Bisphenol A and suitable for use in embodiments to create the thermoset-plastic overcoating layer herein also include those set forth below in Formulas (V)-(VII) wherein n is an integer from about 1 to about 6:

Formula (V)

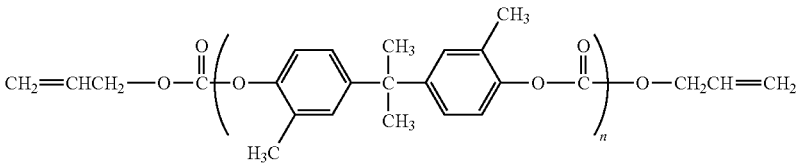

-continued

Formula (VI)

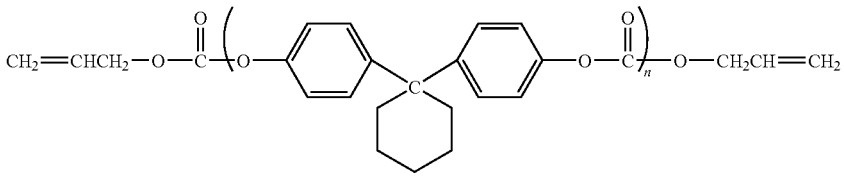

Formula (VII)

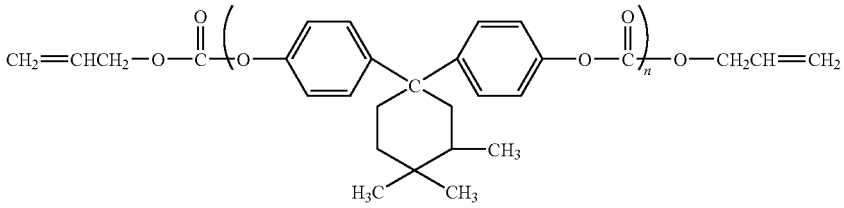

Each of all these high boiling liquids of Formulas I-VII described above may be incorporated into any conventional thermoplastic charge transport layer formed with organic solutions to effect residual solvent flush-out. They are selected based on one important characteristic of being highly compatible with both the polymer binder and the charge transport compound. Also, each has a boiling point that is in excess of 200° C., and more specifically, from about 260° C. to about 330° C.; and yet more preferably, be greater than about 250° C.

Furthermore, the overcoating layer 42 of FIG. 1B created by crosslinking process of one of the above carbonate monomers, if needed to enhance photo-electrical performance, may further contain between about 1 and about 10 weight percent of a charge transport compound, based on the total weight of the resulting overcoat layer. In addition, the charge transport compound selected for the overcoat incorporation may be the same or different from that used in the thermoplastic charge transport layer 40.

For a specific example, an overcoating solution may be prepared by mixing between about 1 and about 5 weight percent of a crosslinking initiator, based on the total weight of the layer, of a crosslinking initiator into the Bisphenol A carbonate liquid of Formula (IV) with constant agitation. On the other hand, an exemplary overcoating solution may also be prepared to have no or include a small quantity of charge transport compound ranging from about 1 to about 10 weight percent of a charge transport compound with the Bisphenol A carbonate liquid of Formula (IV), based on the total weight of the overcoat, with constant agitation. The prepared coating solution is the applied directly over the thermoplastic charge transport layer by dipping, gravure, or slot coating, etc., followed by temperature elevation to 120° C. to initiate the crosslinking reaction which then turns the liquid coating into a solid hard overcoat 42. The crosslinking initiator used can be a benzoyl peroxide, dicumyl peroxide, diisopropyl peroxydicarbonate, dicyclohexyl peroxydicarbonate and the like, including Bis(4-tert.butylcyclohexyl)peroxydicarbonate having the molecular structure given below:

FORMULA (A)

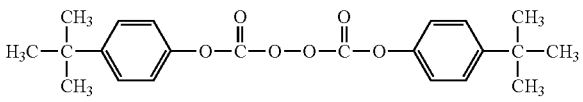

If needed, the coating solution can be diluted with methylene chloride or THF or toluene or any suitable organic solvent in order to satisfy solution viscosity requirement for coating applications. The hard overcoat 42 formed on the thermoplastic charge transport layer 40 should have a thickness of from about 0.5 and about 8 microns to provide satisfactory function; but preferably be between about 2 and about 5 microns thick to produce optimum mechanical/chemical protection as well as photoelectric results.

Since the overcoating layer 42 is formed from crosslinking a carbonate liquid which is chemically similar to the thermoplastic polycarbonate binder of the charge transport layer binder, it does have strong adhesion bonding to the thermoplastic charge transport layer 40. Additionally, the overcoating layer 42 is equally applicable for imaging members comprising the dual or the multiple charge transport layers imaging member designs shown in FIGS. 2 and 3, respectively.

Although the disclosure of creating the thermoset-plastic overcoating layer can be accomplished with the use of each one of these oligomer carbonate liquids (Formula (I) to (VII)) described above, nevertheless it is, specifically, preferred to use the Bisphenol A carbonate monomer of Formula (IV).

Moreover, in order to achieve enhanced wear resistance results in any of the above described embodiments, the thermoset-plastic overcoating layer may further include dispersions of silica, PTFE, waxy polyethylene, and polypropylene wax particles for effective wear life extension.

(3) CREATION OF THERMOSET-PLASTIC CHARGE TRANSPORT LAYER: Alternatively, mechanically robust electrophotographic imaging members may be prepared by totally replacing the thermoplastic charge transport layer 40 of FIG. 1A with a new formulation of thermoset-plastic charge transport layer created by a crosslinking solvent-less process. In these particular exemplary embodiments, the charge transport layer is formed from a solution comprising a charge transport compound, a liquid oligomer carbonate selected from Formulas (I) to (VIII), listed above, and a crosslinking initiator. Since the liquid carbonate is itself functioning as a solvent during coating solution preparation, no other organic solvent is needed. The crosslinking initiator is any substance which is enabling to crosslink the liquid oligomer into a crosslinked solid thermoset-plastic polycarbonate network during an elevated temperature curing step. Furthermore, the liquid oligomer carbonate is also chemically compatible with the charge transport compound. It also functions as a solvent to facilitate charge transport layer coating solution preparation. In this regard, upon application of the coating solution to the charge generating layer, the crosslinking initiator reacts with the liquid carbonate monomer, generally at elevated temperatures, to transform the liquid coating into a solid and mechanically robust thermoset-plastic charge transport layer of this disclosure.

While the above process for producing the charge transport layer is solvent free, if necessary for flow control, etc., the charge transport compound can first be dissolved in a small quantity of any suitable organic solvent such as methylene chloride, THF, toluene, etc., prior to its addition to the liquid carbonate monomer to form the coating solution. Although this coating solution does contain some methylene chloride, etc., it nonetheless is only a very small amount easily be flushed out or eliminated during elevated temperature processing step.

With respect to different types of suitable liquid carbonates, when n=1, $R_1$ is allyl, and $R_3$ and $R_4$ are methyl, the oligomer liquid carbonate described by Formula (III) becomes Formula (IV) which is a specific liquid carbonate monomer [$C_{23}H_{24}O_6$] called bis allyl carbonate of Bisphenol A. It is a liquid that can readily dissolve a charge transport compound. Furthermore, each allyl group at both end of the molecule has a vinyl ($CH_2$=CH—) terminals which allow for crosslinking reaction (by opening up the double bonds in the vinyl group) to take place by a crosslinking initiator to transform the liquid coating into a solid crosslinked polycarbonate coating of thermoset-plastic charge transport layer.

Since the Bisphenol A liquid carbonate monomer has a boiling point over 200° C. and its crosslinked structure is chemically and/or structurally nearly identical to the thermoplastic polycarbonate binder used in a typical thermoplastic charge transport layer formulation, it is compatible with various charge transport compounds to enable formation of a homogenous material matrix thermoset-plastic charge transport layer. Although crosslinking initiators include, for example, such as benzoyl peroxide, dicumyl peroxide, diisopropyl peroxydicarbonate, dicyclohexyl peroxydicarbonate, Bis(4-tert.butylcyclohexyl) peroxydicarbonate and the like, nevertheless peroxydicarbonate, for example the Bis(4-tert-.butylcyclohexyl) peroxydicarbonate as described by Formula (A) is preferably used as initiator because it is itself a carbonate identical to the network matrix carbonate.

Additionally, the material formulation used for creation of thermoplastic charge transport layer described in the preceding for replacing the single thermoplastic charge transport layer 40 of electrophotographic imaging member in FIG. 1A is equally applicable for an imaging member, which may instead comprise dual charge transport layers 40B and 40T such as those illustrated in FIG. 2 but with no overcoat 42. The single charge transport layer may otherwise comprise multiple charge transport layers 40F and 40P as described in FIG. 3 without an over coat 42. In embodiments of imaging member comprising dual charge transport layers or multiple transport layers, only the top charge transport layer is created with thermoset-plastic charge transport layer of the present disclosure. In alternative embodiments, imaging member having dual or multiple charge transport layers, all the layers are created with thermoset-plastic charge transport layers of this disclosure. The dual and multiple charge transport layers may have the same or different material compositions, but the layers must be capable of supporting the injection of photogenerated holes from the charge generating layer and allowing the transport of these holes through these organic layers to selectively discharge the surface charge to create latent image or images. Each layer is normally transparent in a wavelength region in which the electrophotographic imaging member is to be used when exposure is effected therethrough to ensure that most of the incident radiation is utilized by the underlying charge generating layer. Each charge transport layer should exhibit excellent optical transparency with negligible light absorption and neither charge generation nor discharge if any, when exposed to a wavelength of light useful in xerography, e.g., 4000 to 9000 Angstroms. Each layer of these charge transport layers is formed by separate steps; with the bottom layer coated and completely formed over and in conjunction with the charge generating layer 38, then with same procedures all other transport layers are subsequently applied to give complete imaging member material package. Each of the resulting charge transport layers is an insulator to the extent that an electrostatic charge placed on the charge transport layer is not conducted in the absence of illumination.

For imaging members having a thermoplastic charge transport layer or multilayers, although the film forming polymer binder used may be of different materials in the thermoplastic charge transport layers; nonetheless it is preferably to have identical polymer binder for the benefit of providing excellent interfacial adhesion bonding between layers; furthermore, all the layers are also preferred to comprise the same charge transport compound. The polymer binder used for the thermoplastic charge transport layers may be, for example, selected from a group of polycarbonates. It is, however, preferred to used polycarbonate of being a poly(4,4'-isopropylidene diphenyl carbonate) or a poly(4,4'-diphenyl-1,1'-cyclohexane carbonate); whereas the charge transport compound is aryl diamine charge transporting compound represented by molecular structure A:

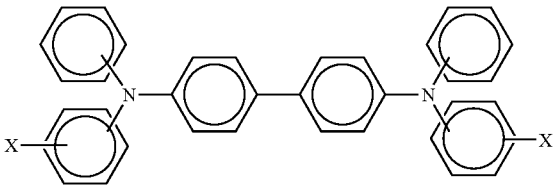

wherein X is selected from the group consisting of alkyl, alkoxy, hydroxy, and halogen. In all these embodiments, an imaging member comprises either dual or multiple charge transport layers, they are discrete and contiguous layers.

The plurality of additional thermoplastic or thermoset-plastic charge transport layers in the above embodiments may further contain a stabilizing antioxidant such as a hindered phenol. Such a phenol can be present in a reversed concentration gradient as that of the charge transport compound. For example, while the concentration of the charge transport compound decreases from the bottom layer (or the layer in closest proximity to the charge generating layer) to the top layer in the overall charge transport layer, the concentration of the hindered phenol increases in the same direction.

An example of such an embodiment includes an imaging member of FIG. 3 comprising:

a supporting flexible substrate 32 having a conductive surface or layer 30, an optional hole blocking layer 34, an optional adhesive layer 36, a charge generating layer 38, a multiplicity of charge transport layers (shown in FIG. 3) consisting of a first or bottom charge transport layer 40F and coated over a plurality of additional charge transport layers 40P; and with charge transport 40F preferred to be thinner than charge transport layer 40P, while each of the plurality of additional layers in the charge transport layer 40P is preferred to have the same thickness but may also be different; all the layers in charge transport layer 40P and charge transport 40F are solid solutions comprising the same film forming polymer binder and very same aromatic amine hole transporting compound of molecular structure A or any one of the aromatic diamines given in the preceding; wherein the first charge transport layer 40F comprises from about 50 to about 90 weight percent hole transport compound with respect to the total weight of the first layer 40F to give satisfactory hole transporting result, nonetheless, a content comprising about 60 to about 70 weight percent is preferred for achieving optimum function. By comparison, the base layer of the plurality of additional charge transport layers 40P is comprised of from about 40 to about 60 weight percent and then in stepwise reduction fashion of aromatic diamines concentration in each subsequent layer of the additional charge transport layers 40P to reach a lowest concentration of between about 10 and about 30 weight percent at the very top layer of the additional charge transport layers 40P with respect to the total weight of each respective layer. Therefore, the top charge transport layer of the plurality of additional charge transport layers 40P contains relatively more polymer binder in the coating layer matrix the base layer.

The imaging member of FIG. 3 may also optionally comprises an overcoating layer 42 of the same disclosures described in FIG. 1B to produce improvement mechanical function. In the event that a protective thermoset plastic overcoat is utilized, the charge transport layer(s) is preferred to remain as thermoplastic layer(s). An anti-curl back coating 33 may also be required to counteract the imaging member upward curling and maintain flatness and a ground strip layer 41 coated to one edge of the imaging member to complete the imaging member design.

Moreover, in certain embodiments wherein the optional protective overcoating layer is absent, the very top layer of the additional charge transport layers 40P is a thermoset layer which may comprise of the liquid carbonate monomer, the charge transport compound and one or more crosslinking initiators. For example, good results have been produced utilizing Bisphenol A carbonate monomer with some aryl diamine charge transport compound identified by molecular structure A above and the crosslinking initiator diisopropyl peroxycarbonate. Although both the charge transport layer 40F and the charge transport layers 40P may be thermoset plastic layers, but they are preferably thermoplastic layers except the very top layer of charge transport layers 40P is a thermoset-plastic layer.

To achieve the desired outcome, it is necessary that each of the charge transport layers of the imaging member in FIG. 3 are solution coated, and then completely and fully dried at elevated temperature prior to the application of the next coating layer. Subsequently thereafter, the very same coating procedure is repeated again for every one of all the subsequent layers to produce the multiplicity of charge transport layers of this disclosure. Any suitable or innovative technique may be utilized to mix and thereafter apply the multiple charge transport layer coating mixture onto the charge generating layer 38. Typical application techniques for each charge transport layer include extrusion die coating, spraying, roll coating, wire wound rod coating, and the like. Drying of each deposited wet coating may be effected by any suitable conventional technique such as oven drying, infra red radiation drying, air drying and the like.

Referring back to FIG. 3, the plurality of layers in charge transport layers 40P, having a stepwise descending concentration gradient of charge transport compound of from being the highest in the base layer to the lowest in the very top layer as described in the described embodiments, is comprised of about 2 to about 15 discreet layers; but preferably to be between 2 and 7 layers, with optimum result from 2 to 3 layers. The thickness of the first or bottom charge transport layer 40F is between about 5 and about 10 micrometers. Although the thickness of the first charge transport layer 40F may be the same to the collective or total thickness of the plurality of layers in the charge transport layer 40P, it is however preferably to be different; while the thickness among each of the plurality of additional charge transport layers 40P may be different, nonetheless it is preferred to be identical of being between about 0.5 and about 7 micrometers. To achieve optimum functional outcome, the total thickness of the first charge transport layer 40F and the plurality of additional charge transport layers 40P should be in the range of between about 10 and about 110 micrometers.

Another further aspect of this disclosure for all respective overcoating layers described in the all the preceding embodiments above may again include incorporation of nano-particles dispersion, such as silica, metal oxides, ACUMIST (waxy polyethylene particles), waxy polypropylene, PTFE, and the like, not to exceed 10 weight percent, based on the total weight of the resulting cross-linked overcoating layer to effect excellent wear resistance enhancement. If desired, a stabilizing antioxidant such as a hindered phenol may also be added in the amount of not to exceed 8 weight percent based on the total weight of the formulated overcoating layer.

Each of the fabricated multilayered, flexible electrophotographic imaging member web stock respectively provide the benefits of having (1) reduced residual solvent in the thermoplastic charge transport layer, (2) the added crosslinked carbonate overcoat and/or (3) a created thermoset plastic charge transport layer, in accordance to all the embodiments described in the preceding, to effect enhanced mechanical performance. The web stocks may be cut into rectangular sheets then brought together by overlapping and joinder by any suitable means including ultrasonic welding, gluing, taping, stapling, and pressure and heat fusing to form a continuous imaging member seamed belt, sleeve, or cylinder. Nevertheless, from the viewpoint of considerations such as ease of belt fabrication, short operation cycle time, and mechanical strength of the fabricated joint, the ultrasonic welding process is more specifically used to join the overlapping edges into a flexible imaging member seamed belt.

The prepared flexible imaging member belt may then be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

Although the flushing out of residual solvent has been demonstrated in various embodiments comprising the production of a thermoplastic charge transport layer, the present disclosure also includes the flushing out of residual solvent in the formation of an anti-curl backing coating as well.

The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Control Example I

An electrophotographic imaging member web was prepared by providing a 0.02 micrometer thick titanium layer coated on a substrate of a biaxially oriented polyethylene naphthalate substrate (KADALEX™, available from Dupont Teijin Films.) having a thickness of 3.5 mils (89 micrometers). The titanized Kadalex™ substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer was of an average dry thickness of 0.04 micrometer as measured with an ellipsometer.

An adhesive interface layer was then applied by extrusion coating to the blocking layer with a coating solution containing 0.16 percent by weight of ARDEL® polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200®, a polycarbonate of poly(4,4'-diphenyl)-1,1'-cyclohexane carbonate (PC-z 200) available from Mitsubishi Gas Chemical Corporation, and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometer.

This coated web stock was simultaneously coated over with a charge transport layer and a ground strip layer by co-extrusion of the coating materials. The charge transport layer was prepared by introducing into an amber glass bottle in a weight ratio of 1:1 (or 50 weight percent of each) of MAKROLON 5705®, a Bisphenol A polycarbonate thermoplastic having a molecular weight of about 120,000 commercially available from Farbensabricken Bayer A. G. and N,N'-diphenyl-N,N'-bis(3-methylphenyl)-1,1'-biphenyl-4,4'-diamine charge transporting compound represented by

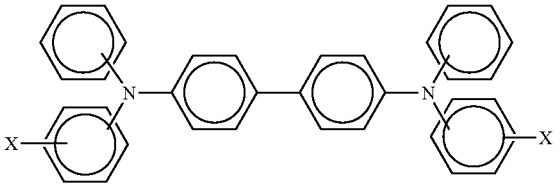

wherein X is a methyl group that attached to the meta position.

The resulting mixture was dissolved to give 15 percent by weight solid in methylene chloride. This solution was applied on the charge generating layer by extrusion to form a coating which upon drying in a forced air oven gave a 29 micrometers dry thickness of charge transport layer.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A. G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip. The resulting imaging member web stock at this point will, if unrestrained, curl spontaneously upward into a 1½ inch tube.

An anti-curl coating was prepared by combining 88.2 grams of polycarbonate resin (MAKROLON® 5705), 7.12 grams VITEL PE-200 copolyester (available from Goodyear Tire and Rubber Company) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 125° C. in a forced air oven for 3 minutes to produce a dried coating layer having a thickness of 17 micrometers and render imaging member flatness. The fabricated imaging member web stock (as shown in FIG. 1A) is to be used as a control.

Control Example II

An electrophotographic imaging member web was prepared in exactly the manner and using the same materials as those described in Control Example I, but with the exception that the charge transport layer was prepared to give dual charge transport layers consisting of a bottom charge transport layer and a top charge transport layer.

In essence, the above coated imaging member web was then coated over with two separate charge transport layers and a ground strip layer using an extrusion co-coating process. Both charge transport layers were prepared by two separate coating solutions by introducing into an amber glass bottle the N,N'-diphenyl-N,N'-bis(3-methylphenyl)-1,1'-biphenyl-4,4'-diamine hole transporting compound and MAKROLON® 5705, a Bisphenol A polycarbonate, poly(4,4'-isopropylidene diphenyl) carbonate, having a weight average molecular weight of about 120,000 and available from Bayer A G, was added to the glass bottle to make up two separate charge transport layer coating solutions each containing 15 weight percent solids in 85 weight percent methylene chloride, but had different concentrations: with the first and second solutions having a 50:50 and a 35:65 weight ratios of transport compound/polycarbonate, respectively. The first solution was applied directly onto the charge generating layer to provide contiguous contact and form a bottom charge transport layer which upon drying at 25° C. for 3 minutes had a thickness of 15 micrometers, while the second coating solution was then subsequently applied over as a top charge transport layer and dried to form a 14 micron thick top charge transport layer. Therefore, the top charge transport layer (comprising 35 percent by weight transport compound and 65 percent by weight polycarbonate MAKROLON® binder) had lesser amount of transport compound content as compared to the bottom charge transport layer (comprising 50 percent by weight of the transporting compound and 50 percent by weight of the polycarbonate MAKROLON® binder), based on the total weight of each layer.

The approximately 10 millimeter wide strip of the adhesive layer left uncoated by the charge generating layer was then coated over with a ground strip layer during the co-coating process with the top transport layer. After drying together of the charge transport layer and the co-coated ground strip layer, at 125° C. in a forced air oven for 3 minutes, it gave a dried ground strip thickness of about 19 micrometers.

An anti-curl back coating of about 17 micrometers in dried thickness was also accordingly coated by following the exact procedures and using same material compositions described in Control Example I to provide the fabricated imaging member with desired flatness as that shown in FIG. 2 but having no overcoat.

Disclosure Example I

Two electrophotographic imaging member webs (each having a single charge transport layer shown in FIG. 1A) were fabricated using the same materials and the same process as that described in the Control Example I, but with the exception that the charge transport layer coating solutions were prepared to include a high boiler Bisphenol A carbonate monomer liquid (boiling point of about 300° C.), in three different amounts, given by Formula (IV) below:

FORMULA (IV)

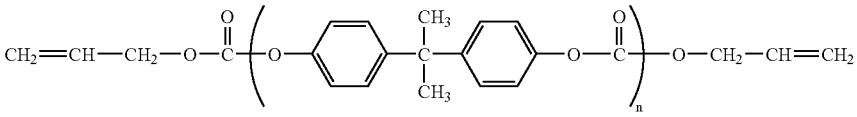

Since this liquid compound is a Bisphenol A bisallyl carbonate monomer (commercially available for PPG, Inc.) to that of polycarbonate Makrolon® 5705 binder, it presence in any amount should have good compatible with the material compositions of the formulated charge transport layer.

The prepared first charge transport layer coating solution was then applied onto the charge generating layer and followed by subsequent drying at elevated temperature to give the resulting imaging member web stocks which contained 2 and 8 weight percent liquid Bisphenol A carbonate monomer incorporation in each respective 29 micrometers dried charge transport layer thickness matrix of the three imaging members.

Disclosure Example II

Two electrophotographic imaging member webs as that shown in FIG. 2 but with no overcoat layer (having dual charge transport layers to contain 2 levels of the high boiler Bisphenol A carbonate monomer liquid of Formula (IV) incorporation) were fabricated using the same materials and the same process as that described in the Control Example II, but with the exception that the material matrix of each of both the top and the bottom layers of the dual charge transport layers of the prepared first imaging member web stock was incorporated with 2 weight percent, based on the total weight of each layer, of the high boiler Bisphenol A carbonate monomer liquid.

For the prepared second imaging member web stock, an 8 weight percent liquid carbonate loading level was incorporated in each of both dual charge transport layers.

Residual Solvent and Tg Determinations

The prepared electrophotographic imaging member web stocks of Control Example I and Disclosure Example I (each having a single charge transport layer) were analyzed for residual methylene content in their respective charge transport layer. In addition, the glass transition temperature (Tg) of the charge transport layers were also determined by differential scanning calorimetry measurement (DSC) to assess the impact of high boiler liquid presence in each layer's material matrix on the mechanical property of the resulting charge transport layer. The results obtained are presented in Table 1 below:

TABLE 1

| Example of Imaging Member | Liquid added to CTL | Residual Solvent in CTL | Tg of CTL |
|---|---|---|---|
| Control I | None | 1.89% wt | 86 |
| Discl. Example I | 2% wt carbonate | 0.33% wt | 84 |
| Discl. Example I | 8% wt carbonate | 0.30% wt | 72 |

As the data listed in the above table, incorporation of a high boiler carbonate liquid, of between 2 and 8 weight percent, to the charge transport layer of a fabricated electrophotographic imaging member could reduce the methylene chloride residue from the layer by about 85%. Even at a mere 2 percent by weight incorporation, residual solvent reduction was very effective to produce the maximum outcome. Although incorporation of the liquid Bisphenol A carbonate monomer was found to cause Tg depression of the resulting charge transport layer, nonetheless the maximum Tg reduction to 72° C. seen for the charge transport layer (containing 8 weight percent carbonate liquid loading) shall not cause any practical imaging member's performance impact because it is still way above the typical imaging machine's functioning temperature of 45° C. in the field. Additionally, analysis conducted for residual solvent reduction and Tg measurements for imaging members comprising dual charge transport layers of Disclosure Example II and the Control Example II counterpart gave the same results shown in Table. This is further supporting evidence of effectiveness of carbonate liquid incorporation in flushing out the methylene chloride residual solvent from the charge transport layer of a prepared imaging member. One important observation also worth mentioning here is that the imaging member of Control Example I (comprising a single charge transport layer) and the imaging member of Control Example II (comprising dual charge transport layers), having no carbonate liquid incorporation, were both found to exhibit some degree of undesirable imaging member upward curling after about 8 weeks of use. This was due to the consequence of eventual out-gassing of the residual solvent, resulting in the development of build-in internal strain in the charge transport layer as a result of dimensional contraction in the layer.

Furthermore, it is also important to note that the mechanical properties, such as Young's Modulus, ultimate strength, break elongation, and surface coefficient of friction of the charge transport layer formulated according to this invention were not being affected by the result of both 2 and 8 weight percent loading levels, using carbonate liquid incorporation Photoelectrical and Corona Exposure Testings The imaging member webs of all the above Examples were evaluated for photoelectrical properties and corona effluents exposure tests.

The photoelectrical testing results obtained from the electrical scanner showed that electrophotographic imaging members prepared to have charge transport layer formulated according to the present disclosure did exhibit equivalent electrical functional characteristic, such as for example, photoelectrical cyclic stability, charge acceptance, photo induce discharge sensitivity, dark decay potential, depletion voltage, and background and residual voltage as compared to that of each respective imaging member control counterpart. These results, therefore, indicate that the incorporation of the selected high boiler carbonate liquid additives to the charge transport layer would not cause deleterious photoelectrical impacts to affect the fabricated imaging members function.

All the imaging members prepared, as described in the preceding Examples, were allowed to sit in the shelf for 5 weeks and then each cut to provide five 2"×3" sample pieces, followed by individually rolling each cut piece, with the charge transport layer facing outwardly, into a 19 millimeter diameter sample tube. These imaging member sample tubes were then subjected to corona effluents exposure tests. Corona effluents were generated by turning on a charging device in an enclosed large glass tubing operated under 700 micro-amperes and 8 KV conditions. The corona effluent exposure test was accomplished by placing these imaging member sample tubes inside the enclosed glass tube and simultaneously exposing the samples to the gaseous effluents for 6 hours time duration. Examination of each of these samples, under 70× magnification with an optical microscope, after exposure, had found that corona species interaction with the imaging member charge transport layer (while the sample was under the static bending strain condition) for the invention imaging members did not have the development of charge transport layer cracking, while each of the control imaging member counterpart had developed extensive corona exposure bending strain induced charge transport layer cracking.

The observed control sample cracking is due to the direct result of internal strain development that built-up in the charge transport layer by the eventual loss of residual solvent after 5 weeks of elapse time imaging member storage in the shelf. Therefore, elimination of residual solvent from the charge transport layer of imaging member by the invention disclosure offers a simple and easily implementable approach to effect imaging member functional life extension.

Disclosure Example III

An electrophotographic imaging member web was fabricated in exactly the manner and using the same materials according to those described in Control Example I, but with the exception that a protective overcoating layer was added to the imaging member of FIG. 1A to produce a resulting imaging member having the material structure as that shown in the illustration of FIG. 1B.

A coating solution for creating the overcoating layer was prepared by selecting a liquid Bisphenol A bis(allyl carbonate) monomer commercially available from PPG Industries, Inc., having the below molecular structure:

FORMULA (IV)

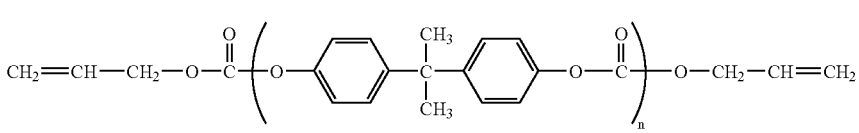

The carbonate liquid was mixed with 3 weight percent of the crosslinking initiator, diisopropyl peroxycarbonate (commercially available from PPG Industries, Inc.), based on the total weight of the carbonate liquid and the initiator. The mixture was then diluted with methylene chloride to produce a coating solution containing 20 weight percent of the carbonate liquid and the initiator dissolved in 80 weight percent methylene chloride. The coating solution was then subsequently applied over the charge transport layer, using and half mil gap Bird applicator by hand coating. The liquid coating layer was dried at 120° C. to remove the methylene chloride and initiate the crosslinking reaction of the ally carbonate to form a network of solid overcoating layer having a thickness of about 3 micrometers in thickness.

Since the Bisphenol A bisallyl carbonate monomer has a similar chemical structure to the polycarbonate Makrolon® 5705 binder in the charge transport layer, the overcoating layer created after crosslinking provided good adhesion bonding to the charge transport layer. Additionally, the compositions of the overcoating layer exhibited good compatibility with the material compositions of the formulated charge transport layer.

Disclosure Example IV

A dual charge transport layer electrophotographic imaging member web was fabricated in exactly the manner and using the same materials according to those described in Control Example II, but with the exception that top charge transport layer was replaced with a thermoset-plastic charge transport layer such as that disclosed herein. The coating solution of this top charge transport layer was prepared by dissolving 35 part by weight N,N'-diphenyl-N,N'-bis(3-methylphenyl)-1,1'-biphenyl-4,4'-diamine charge transporting compound in 65 part by weight Bisphenol A monomer liquid of Formula (IV), plus a 3 weight percent of crosslinking initiator diisopropyl peroxycarbonate. The prepared coating solution was then applied directly over the bottom charge transport layer. The applied coating was then converted into a crosslinked solid top charge transport layer to produce a resulting imaging member with improved mechanical function.

Mechanical/Chemical and Electrical Evaluations

The electrophotographic imaging member of Disclosure Example III and the imaging member of Control Example I were each assessed for dynamic fatigue charge transport layer cracking failure, corona effluents and solvent vapor exposure tests, and photo-electrical properties.

For dynamic fatigue testing, each of these electrophotographic imaging members was cut to give a test sample size of 1 inch (2.54 cm.) by 12 inches (30.48 cm.) and each dynamically tested to the point that occurrence of fatigue charge transport layer cracking became evidence. Testing was effected by means of a dynamic mechanical cycling device in which free rotating (idle) rollers were employed to repeatedly bend and flex each imaging member test sample to induce fatigue strain in the charge transport layer as to simulate an imaging member belt cyclic function under a machine service condition. More specifically, one end of the test sample was clamped to a stationary post and the sample was then looped upwardly over three equally spaced horizontal idling rollers and then downwardly through a generally inverted "U" shaped path with the free end of the sample secured to a weight which provided one pound per inch width tension on the sample. The outer surface of the imaging member bearing the overcoating layer of Disclosure Example III and the charge transport layer of the Control Example I imaging member were faced outwardly, so that the outer most layer of the imaging member samples would periodically be brought into dynamic bending/flexing contact as the idling rollers were repeatedly passing underneath the test sample to cause mechanical fatigue charge transport layer strain. The idling rollers had a diameter of one inch.

Each idling roller was secured at each end to an adjacent vertical surface of a pair of disks that were rotatable about a shaft connecting the centers of the disks. The rollers were parallel to and equidistant from each other and equidistant from the shaft connecting the centers of the disks. Although the disks were rotated about the shaft, each roller was secured to the disk but rotating freely around each individual roller axis. Thus, as the disk rotated about the shaft, two rollers were maintained at all times in rotating contact with the back surface of the test sample. The axis of each roller was positioned about 4 cm from the shaft. The direction of movement of the rollers along the charge transport layer surface was away from the weighted end of the sample toward the end clamped to the stationary post to maintain a constant one pound per inch wide sample tension. Since there were three idling rollers in the test device, each complete rotation cycle of the disk would produce three fatigue bending flexes strain in the charge transport layer since the segment of the imaging member sample was making a mechanical contact with only one single roller at a time during each testing cycle. The rotation of the spinning disk was adjusted to provide the equivalent of 11.3 inches (28.7 cm.) per second tangential speed. The onset of charge transport layer cracking was notable for the imaging member of Control Example I after 105,000 bending flexes whereas the sample having the overcoating layer counterpart of the disclosure, i.e., Example III, went beyond 1.5 million fatigue flexing without notable layer cracking failure.

The imaging members of the Control Example I and Example III were then cut to provide five 2"×3" sample pieces, followed by individually rolling each, with the outermost exposed layer facing outwardly, into a 19 millimeter diameter sample tube. These imaging member sample tubes were then subjected to corona effluents exposure tests. Corona effluents were generated by turning on a charging device in an enclosed large glass tubing operated under 700 micro-amperes and 8 KV conditions. The corona effluent exposure test was accomplished by placing these imaging member sample tubes inside the enclosed glass tube and simultaneously exposing the samples to the gaseous effluents for 6 hours time duration. Examination of the samples, under 100× magnification with a stereo optical microscope after exposure test, indicated that corona species interaction, while the sample was under a static bending strain condition, did cause severe charge transport layer cracking in the Control Example I, the imaging member containing the crosslinked carbonate overcoating layer counterpart, i.e., Disclosure Example III, was free of layer cracking failure, indicating its effectiveness in providing protective insulation to the underneath charge transport layer to corona effluents attack.

To evaluate the charge transport layer cracking resistance to solvent vapor exposure, the above imaging members of Control Example I and Disclosure Example III were each cut to give 2 inches×3 inches test samples. Each of these test samples was then rolled-up into a 19 mm tube, with the outermost exposed layer facing outwardly to induce bending strain, and solvent vapor exposure test was carried out by subjecting them to methylene chloride vapor exposure until the time that charge transport layer cracking became visually evident under 100× magnification with a stereo optical microscope. The results obtained, similar to those found for corona exposure test, show that imaging member solvent vapor exposure charge transport layer cracking problem could effectively be eliminated by providing the imaging member with a protective crosslinked overcoating layer of the present disclosure.

In addition to the abovementioned mechanical robustness to provide life longevity of imaging member belt function under a normal machine service environment, it is also worth further pointing out that the overcoating layer of this disclosure, being an inherently hard coating, should also provide the resulting imaging member with an added benefit of wear and scratch resistance enhancement.

Electrical Property of these electrophotographic imaging members was also determined. It is important to mentioned that no deleterious photo-electrical property impacts on charge acceptance, dark decay, residual/background voltages, photosensitivity, and long term cycling stability for the development imaging member was evident as compared to those results obtained for the control imaging member counterpart.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member comprising:

a substrate, wherein the substrate is electrically conductive;

a charge generating layer;

a charge transport layer; and, an overcoating layer, wherein the overcoating layer is formed from a coating solution comprising a crosslinkable oligomer liquid carbonate and a crosslinking initiator;

wherein the liquid carbonate is of Formula (III), (IV), (V), (VI), or (VII):

FORMULA (III)

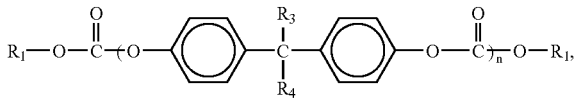

wherein $R_1$ is unsaturated hydrocarbon alkenyl group having from about 2 to about 5 carbon atoms, $R_3$ and $R_4$ are the same or different alkyl groups having about 1 to about 3 carbon atoms, and n is an integer from about 1 to about 6;

FORMULA (IV)

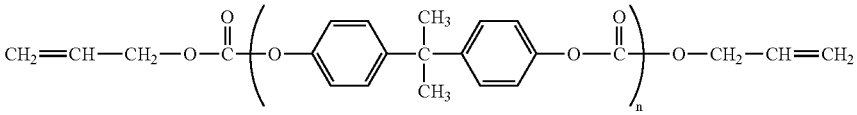

FORMULA (V)

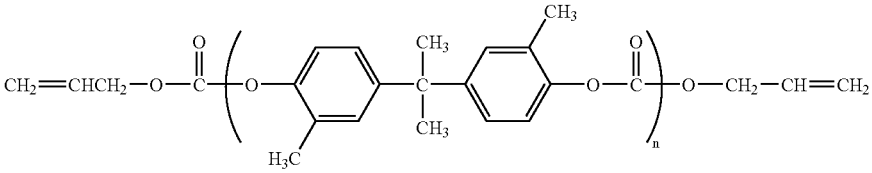

wherein n=1 to 6;

FORMULA (VI)

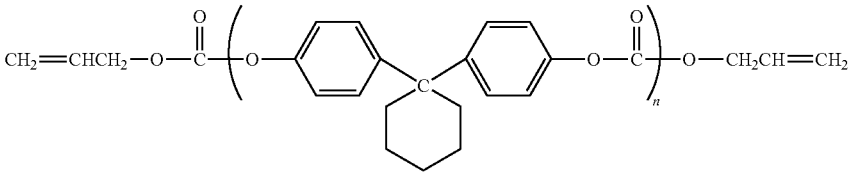

wherein n=1 to 6;

FORMULA (VII)

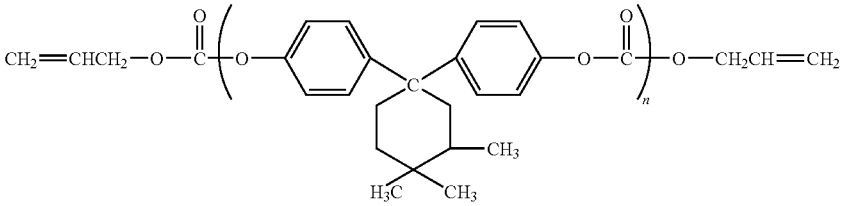

wherein n=1 to 6.

2. The imaging member of claim 1, wherein the crosslinking initiator is selected from the group consisting of benzoyl peroxide, dicumyl peroxide, diisopropyl peroxydicarbonate, bis(4-tertbutylcyclohexyl) peroxydicarbonate, and dichlorohexyl peroxydicarbonate.

3. The imaging member of claim 2, wherein the crosslinking initiator is bis(4-tertbutylcyclohexyl) peroxydicarbonate.

4. The imaging member of claim 1, wherein the overcoating layer further comprises a nano particle dispersion wherein the particles are selected from the group consisting of silica, metal oxides, waxy polyethylene, waxy polypropylene, and PTFE particles.

FORMULA (III)

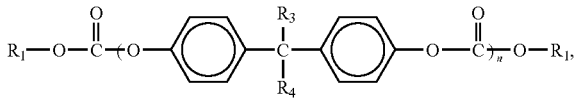

wherein $R_1$ is unsaturated hydrocarbon alkenyl group at each molecular terminal having from about 2 to about 5 carbon atoms, $R_3$ and $R_4$ are the same or different alkyl groups having about 1 to about 3 carbon atoms, and n is an integer from about 1 to about 6.

13. The imaging member of claim 12, wherein the liquid carbonate is of the formula

FORMULA (IV)

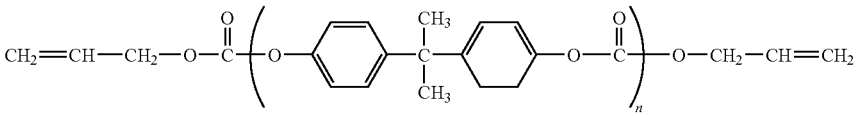

wherein n=1.

5. The imaging member of claim 1, wherein the coating solution prepared for producing the overcoat layer is further comprised of an organic solvent.

6. The imaging member of claim 1, wherein the overcoating layer has a thickness of from about 0.5 micron to about 8 microns.

7. The imaging member of claim 6, wherein the overcoating layer has a thickness of from about 2 microns to about 4 microns.

8. An imaging member comprising:

a substrate, wherein the substrate is electrically conductive;

a charge generating layer;

a charge transport layer; and, an overcoating layer, wherein the overcoating layer is formed from a coating solution comprising a crosslinkable oligomer liquid carbonate, a crosslinking initiator, and a charge transport compound.

9. The imaging member of claim 8, wherein the charge transport compound is an aryl amine or diamine.

10. The imaging member of claim 8, wherein the coating solution comprises from about 1 to about 10 weight percent of a charge transport compound and from about 1% wt to about 5% wt of a crosslinking initiator based on the total weight of the overcoat.

11. A photoconductive imaging member comprising:

a supporting substrate, the substrate either being electrically conductive or comprising an electrically conductive layer;

a charge generating layer; and, a thermoset-plastic charge transport layer comprising one or more layers wherein the top outermost exposed layer comprises a crosslinkable oligomer liquid carbonate, a charge transport compound and a crosslinking initiator.

12. The imaging member of claim 11, wherein the liquid carbonate is of the formula 14. The imaging member of claim 11, wherein the crosslinking initiator is selected from the group consisting of benzoyl peroxide, dicumyl peroxide, diisopropyl peroxydicarbonate, bis(4-tertbutylcyclohexyl) peroxydicarbonate, and dichlorohexyl peroxydicarbonate.

15. The imaging member of claim 14, wherein the crosslinking initiator is bis(4-tertbutylcyclohexyl) peroxydicarbonate.

16. The imaging member of claim 11, wherein the charge transport compound is an aryl amine or diamine.

17. A process for reducing the residual organic solvent retention in a charge transport layer of an imaging member, the imaging member comprising a substrate, the substrate either being electrically conductive or comprising an electrically conductive layer, and the process comprising:

forming a solution comprising a polycarbonate binder, an organic solvent, a charge transport compound, and a high boiler bisphenol A carbonate liquid;

applying the solution to a charge generating layer of an imaging member; and, drying the solution to form a solid solution.

18. The process of claim 17, wherein said organic solvent is selected from the group consisting of methylene chloride, toluene, and THF.

19. The imaging member produced by the process of claim 17.

20. The process of claim 17, wherein the high boiler carbonate liquid is present in amounts from about 0.5 weight percent to about 15 weight percent based on the total weight of the charge transport layer.

21. The process of claim 17, wherein the high boiler Bisphenol A carbonate liquid is

FORMULA (IV)

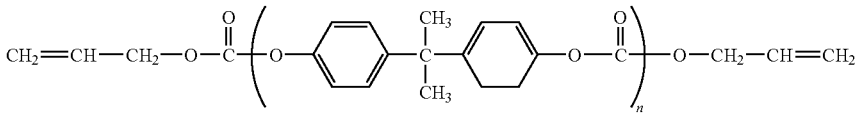

wherein n=1.

22. The process of claim 17, wherein the charge transport compound is an aryl amine or diamine.

23. The process of claim 22, wherein the aryl diamine is of the formula

FORMULA (I)

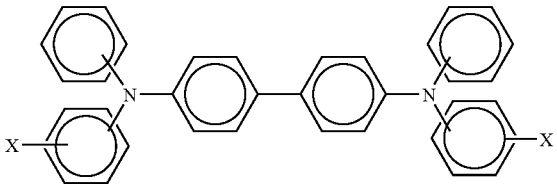

wherein X is selected from the group consisting of alkyl, alkoxy, hydroxyl, and halogen.

24. The process of claim 17, wherein the charge transport compound is selected from the group consisting of triphenylmethane, bis(4-diethylamine-2-methylphenyl)phenylmethane, stilbene, hydrazone, tritolylamine; arylamine; enamine phenanthrene diamine; N,N'-bis-(3,4-dimethylphenyl)-4-biphenyl amine; N,N'-bis-(4-methylphenyl)-N,N'-bis(4-ethylphenyl)-1,1'-3,3'-dimethylbiphenyl)-4,4'-diamine; 4-4'-bis(diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(4-methyl-phenyl)-1,1'-biphenyl-4,4'-diamine; N,N'-diphenyl-N,N'-bis(alkylphenyl)-1,1'-biphenyl-4,4'-diamine; and, N,N'-diphenyl-N,N'-bis(chlorophenyl)-1,1'-biphenyl-4,4'-diamine.

* * * * *